United States Patent [19]

Matsui et al.

[11] Patent Number: 4,874,639

[45] Date of Patent: Oct. 17, 1989

[54] COATING METHOD IN COATING LINE AND COATING APPARATUS THEREFOR

[75] Inventors: Masataka Matsui; Toshiaki Aono; Yoshio Tanimoto; Tadamitsu Nakahama; Takakazu Yamane, all of Hiroshima, Japan

[73] Assignee: Mazda Motor Corporation, Hiroshima, Japan

[21] Appl. No.: 100,767

[22] Filed: Sep. 24, 1987

[30] Foreign Application Priority Data

| | | | |
|---|---|---|---|
| Sep. 25, 1986 | [JP] | Japan | 61-226458 |
| Mar. 26, 1987 | [JP] | Japan | 62-70388 |
| Mar. 26, 1987 | [JP] | Japan | 62-70389 |
| Apr. 30, 1987 | [JP] | Japan | 62-104426 |
| Apr. 30, 1987 | [JP] | Japan | 62-104427 |

[51] Int. Cl.[4] ..... B05D 1/02

[52] U.S. Cl. ..... 427/240; 427/346; 427/425; 118/56

[58] Field of Search ..... 118/56; 427/346, 425, 427/240

[56] References Cited

U.S. PATENT DOCUMENTS

| | | | |
|---|---|---|---|
| 1,948,091 | 2/1934 | Alvey et al. | 118/56 |
| 2,598,163 | 5/1952 | Halls | 118/56 X |
| 2,658,008 | 11/1953 | Williams et al. | 118/56 X |
| 4,092,953 | 6/1978 | Waugh | 118/642 |

FOREIGN PATENT DOCUMENTS

| | | |
|---|---|---|
| 3520924 | 12/1985 | Fed. Rep. of Germany . |
| 48-67332 | 9/1973 | Japan . |
| 51-2228 | 1/1976 | Japan . |
| 57-30581 | 1/1982 | Japan . |
| 58-80390 | 5/1983 | Japan . |
| 59-109430 | 7/1984 | Japan . |
| 60-21361 | 2/1985 | Japan . |

OTHER PUBLICATIONS

Japanese Patent Publication No. 4,471/1984 (Jan., 1984).

Japanese Utility Model Publication No. 20053/1981 (May, 1981).

*Primary Examiner*—Shrive Beck

*Attorney, Agent, or Firm*—Wegner & Bretschneider

[57] ABSTRACT

The coating method contains a spraying step in which a paint is sprayed at least on a coating substrate extending in an upward and downward direction to a film thickness thicker than causing sags of the sprayed paint. The coating substrate on which the paint is sprayed is rotated about the horizontal axis while the sprayed paint is dried until it does not sag any more.

The coating apparatus includes a carriage conveying the coating substrate arranged to run along the conveying direction, and the carriage is provided with a supporting base for supporting the coating substrate rotatively about the horizontal axis. One embodiment for rotating the substrate supported by the supporting base is a spring that is disposed on the carriage to rotate the substrate by means of a restoring force produced by the spring. On the passage for conveying the carriage is disposed a force storing mechanism for storing the restoring force in the spring that released the restoring force.

Another embodiment therefor is a combination of a chain disposed along the conveying passage for the carriage with a sprocket disposed on the carriage. The sprocket is engageable with the chain and operatively coupled to the coating substrate. By disposing the chain in a fixed manner, on the one hand, the substrate is caused to rotate as the carriage is being conveyed. By dividing the chain, on the other, the substrate is caused to rotate while the conveyance of the carriage is suspended.

46 Claims, 26 Drawing Sheets

COATING METHOD IN COATING LINE AND COATING APPARATUS THEREFOR

FIELD OF THE INVENTION

The present invention relates to a coating method in a coating line and a coating apparatus therefor. More particularly, the present invention relates to the coating method applicable in the coating line involving a spraying step for spraying a paint on a coating substrate and a drying step for drying the paint coated thereon and to the coating apparatus suitable for the coating method.

BACKGROUND OF THE INVENTION

Coating substrates such as vehicle bodies are coated during a series of steps constituting a coating line while the vehicle bodies are being conveyed with hangers or carriages. The coating line involves at least a spraying step for spraying an intermediate coat or a top coat and a drying step for drying the coat sprayed on the vehicle body. The drying step may be broken down into a setting step and a baking step when a thermosetting paint or a two-part setting-type paint is employed as a coating paint. The setting step is designed to volatilize a solvent in a range of relatively low temperatures such as room temperatures to a sufficient degree, and the baking step is to bake the coat at elevated temperatures. In instances where a powder coating is employed as a coating paint, the drying step involves the baking step only because no such powder coating contains any volatile solvent.

The paint on the coating substrate is generally sprayed with a spray gun. The spraying is also effected from a transverse direction on a surface of the coating substrate extending in the vertical direction, hereinafter will be referred to as a vertical surface. The spraying of the paint in the transverse direction allows a coating to be formed in a predetermined film thickness with accuracy.

A degree of evenness on a coated surface is determined as one of standards evaluating the quality of the coated surface. The degree of evenness gets higher as irregularities in the coated surface gets smaller, leading to a higher quality. It is known that a film thickness of a coat sprayed on a coating substrate gets thicker as a higher degree of evenness is achieved.

However, when a paint is sprayed on a coating surface, the paint is caused to sag on the coated surface and such sages impairs a quality of the coated surface. The sags may be caused to occur as the paint sprayed flows downwardly or droops by the gravity so that a film thickness of the paint sprayed gets thicker as the sags are more likely to occur. As the sags occur by an influence of the gravity, they may be likely to occur on a coated surface extending in the downward or upward direction such as the vertical surface. On a surface of a coating substrate extending in the horizontal direction, or a transverse surface, causing no big problems with sagging may be formed a thicker film than a film coated on the vertical surface. If a film thickness of a coat formed on the transverse surface is as thick as that of a coat formed on the vertical surface, the former can provide a degree of evenness higher than the latter because the paint coated on the transverse surface is caused to flow to such an extent that it causes no sags.

Heretofore, attempts have been made to prevent a coated paint from sagging and at the same time to provide a degree of evenness as high as possible on the coated surface by using a paint with a possibly lower degree of flowability. A sagging threshold value or a limit on a film thickness of a paint coated causing no sags is known to be as thick as 40 μm for a thermosetting paint although the sagging threshold value varies with kinds of paints. Accordingly, in instances where a thermosetting paint is employed as a coating paint, a film thickness to be coated on the vehicle body in the spraying step is determined such that no sags are caused to occur at the early stages of the setting step and the baking step, particularly at the early stage of the baking step because the sags are likely to occur at these stages. Thus, in order to form a coated surface with a higher degree of evenness, it is necessary in conventional spraying procedures to plurally effect the spraying or repeat a series of steps from the spraying step to the baking step. From the different point of view, a predetermined film thickness of a paint coated immediately after the spraying can be controlled with accuracy in the spraying technique so that the film thickness is rendered as thicker as possible within a range that causes no sags.

In instances where a two-part setting-type paint is used, on the one hand, sags are likely to occur in the setting step and a sagging threshold value for a two-part setting-type paint is as thick as approximately 40 μm. In instances where a powder coating is used, on the other, the paint is most likely to sag in the baking step and a sagging threshold value for it is as thick as approximately 80 μm. As thermosetting paints and two-part setting paints flowable at room temperature is extremely high in flowability and low in viscosity, sags are likely to occur immediately after they were sprayed. The same thing can be said when a paint is sprayed too much.

SUMMARY OF THE INVENTION

The present invention has a major object to provide a coating method in a coating line capable of overcoming the problem with sags of a paint sprayed on a coating substrate and forming a coating surface with a higher degree of evenness when the film thicknesses are identical to each other.

The present invention has another major object to provide a coating apparatus suitable for the coating method according to the present invention, particularly advantageous in the coating line from the nonexplosive point of view.

In order to achieve the object according to the present invention, the coating method is basically designed so as to relatively alter a direction of the gravity acting on a paint sprayed on a coating substrate, thus providing a coated surface with a higher degree of eveness by utilizing a flowability of the paint peculiar in nature. More specifically, the coating method comprises the spraying step in which the paint is sprayed to form a coat in a film thickness thicker than causing sags on a surface extending at least upwardly and downwardly and the drying step in which the coating substrate is rotated about the horizontal axis until the paint sprayed thereon becomes set in such a state as causing no sags.

The coating method according to the present invention provides a coat of a paint with a film thickness much thicker than coats formed by conventional coating methods and a coated surface with a degree of evenness exceeding by far and higher than a limit imposed on conventional coating methods.

In accordance with the present invention, a coated surface with smaller irregularities and higher degree of evenness than and superior in quality to a coated surface coated in conventional manner can be obtained utilizing a flowability of the paint even if film thicknesses were identical to each other.

In order to obtain a coated surface with a degree of evenness equal to a degree of evenness on a surface coated by conventional coating procedures, a film thickness of the former coated surface can be rendered thinner than the latter coated surface, thus reducing an amount of the paint to be coated.

The coating method according to the present invention permits a paint to be sprayed or coated plurally, for example, two or three times, to form a coat with a predetermined film thickness. When a surface area to be coated is wide, a considerable long period of time is required until the whole surface area is sprayed thoroughly. In this case, the paint may be preferably sprayed separately. For example, the paint may be sprayed first in an amount accounting for about two-third of a sagging threshold value and then in an amount exceeding the sagging threshold value.

In instances where a paint to be sprayed has an extremely high flowability and it should be coated in an extremely great film thickness, sags are likely to occur immediately after the completion of spraying. In this case, a coated substrate may be caused to rotate at the later stage of the spraying step.

The spraying of a paint on coating substrates such as vehicle bodies may be effected in conventional manner such as by the electrostatic coating method.

The coating apparatus according to the present invention is used to rotate the coating substrates such as vehicle bodies subject to the coating method according thereto. The coating apparatus basically utilizes a carriage to be conveyed along a coating line, which contains supporting means for supporting the coating substrate loaded on the carriage rotatively about the horizontal axis of rotation. In order to drive the rotation of the coated substrate supported by the supporting means, a spring may be employed as one embodiment. The carriage is provided with the spring and a transmitting mechanism for transmitting the restoring force stored by the spring as a rotating force to the coating substrate. On a passage of conveying the carriages is mounted force storing means for storing the restoring force again on the spring from which the restoring force has once been released. Thus this arrangement permits a rotation of the coating substrate by utilizing the restoring force of the spring, thereby causing no problems at all with explosion.

The present invention has the advantage that a mechanism for rotating the coating substrates is rendered less expensive in manufacturing and operating costs because the springs are employed as sources of driving the rotation.

As another embodiment for rotating the coating substrate supported rotatively on a carriage, there may be used a displacement of the carriage against the conveying rails. For this purpose, the carriage is provided with a converting mechanism for converting the displacement of the carriage against the conveying rails into a rotating force. Such a mechanism may contain a chain or a rack disposed along the conveying rails and a sprocket or a pinion supported rotatively to the carriage and engaged with the chain or the rack. The sprocket or the pinion is in turn connected to the coating substrate. This construction renders an overall structure of a coating apparatus simple and manufacturing and operating costs less expensive.

The other objects and advantages of the present invention will become apparent in the course of description of the specification by way of embodiments with reference to the attached drawings.

DETAILED DESCRIPTION OF THE PREFERRED EMBODIMENTS

The present invention will be described more in detail by way of embodiments with reference to the drawings attached hereto. It is to be understood herein that the following description should be interpreted as illustrative and not limiting the present invention in any means.

Outline of Overcoating Step

Figure 1:
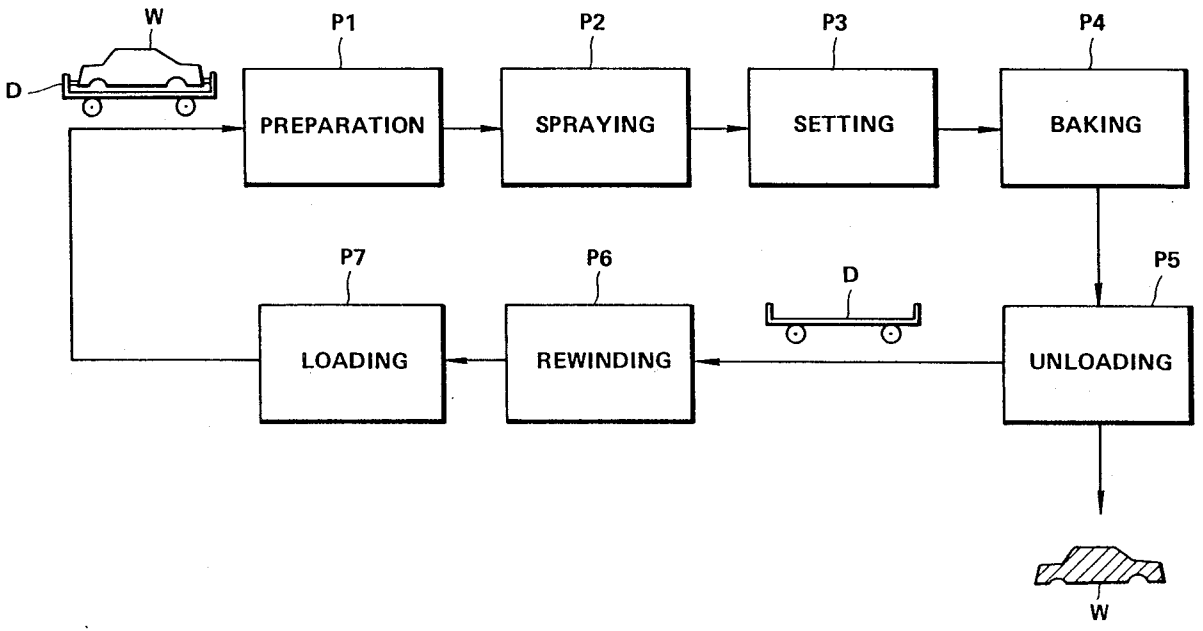
FIG. 1 is a flow chart of an overall step illustrating one example of the coating method according to the present invention.

FIG. 1 shows an outline of an overcoating step of coating a top coat on a vehicle body W. In FIG. 1 P1 to P7, inclusive, denote each of the steps constituting the overcoating step. It is to be noted here that, although the following embodiment will take the overcoating step as an example, the present invention is applicable to any other coating step and apparatus.

A vehicle body W is coated first with an undercoat by means of the electrodeposition coating method and then with an intermediate coat in conventional manner. The vehicle body W is then loaded on a carriage D and conveyed to a preparation step P1. The carriage D is provided with a rotation driving unit to rotate the vehicle body W utilizing the restoring force of a spring, as will be described in more detail hereinafter.

A preparation step P1 is to clean the vehicle body W prior to the spraying of a top coat by removing foreign material such as dirt by air blow or vacuum suction.

A spraying step P2 is to spray a top coat—a thermosetting paint in this embodiment—on the vehicle body W conveyed from the preparation step P1.

The sprayed top coat is dried and baked in a setting step P3 and a baking step P4. In the setting and baking steps P3 and P4, respectively, the vehicle body W is rotated using the restoring force of the spring in such a manner as will be described hereinafter.

The vehicle body W so baked in the baking step P4 is then conveyed to an unloading step P5 where the vehicle body W is unloaded from the carriage D. The vehicle body W may be reloaded on a carriage and conveyed to an assembly line, and the empty carriage D is conveyed to a rewinding step P6. In the rewinding step P6, an exterior force is applied to the spring as a source for driving a rotation to store the restoring source therewithin. The carriage D having the spring with the restoring force is then conveyed to a loading step P7.

In the loading step P7, such carriage D is loaded with a vehicle body W that had been coated with an intermediate coat in the previous steps. Thje vehicle body W is then conveyed to the preparation step P1 and the following steps constituting the overcoating step as have been described above. The carriage D is designed to circulate the overcoating step starting from the preparation step P1 and ending with the loading step P7.

Removal of Foreign Materials

Figure 2:
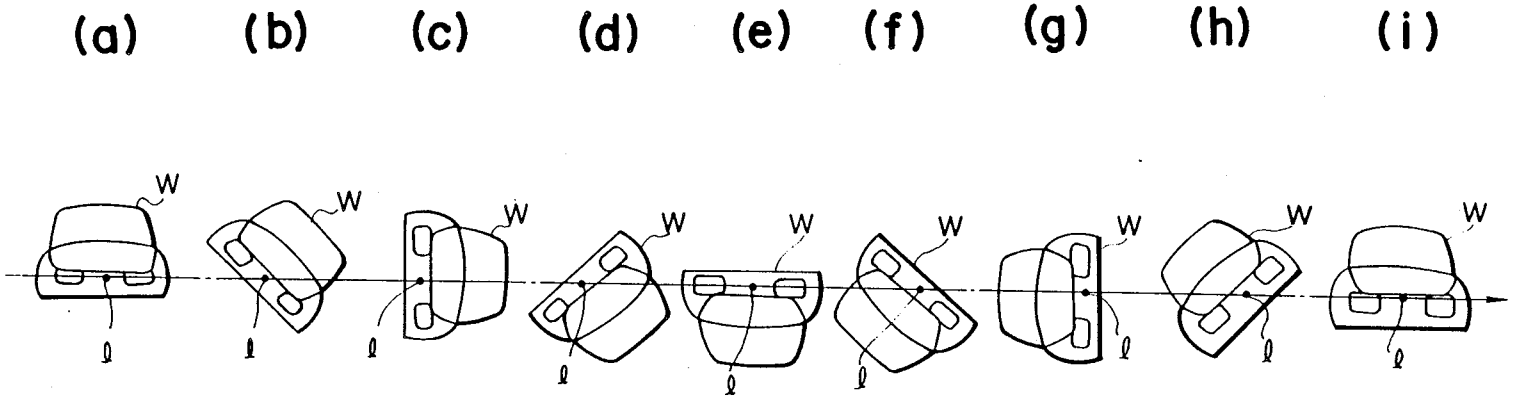
FIG. 2 is a diagrammatical view illustrating variations in states of a rotating vehicle body.

Foreign materials such as dirts may be removed in the preparation step P1 as the vehicle body W is rotated about the horizontal axis 1 as shown in FIG. 2. For instance, the vehicle body W is first rotated to the position (a) in FIG. 2 and suspended at that position to clean it by removing the foreign materials. The carriage D may then be operated to rotate the vehicle body W to the position (b) and suspended at that position to do cleaning work. This operation may be likewise repeated to rotate the vehicle body W continuously or intermittently from the position (b) through (c), (d), (e), (f), (g) and (h) to the position (i). And it is a matter of course that the rotation of the vehicle body W may be reversed at any position to the original position (a).

The rotation of the vehicle body W in the preparation step P1 permits removal of such foreign materials as adhering to corner portions inside the roof panel thereof or closed sections of side sills or as being unlikely to be thoroughly removed therefrom unless the vehicle body W is rotated to cause them to fall down.

Spraying and Drying of Top Coat

In the spraying step P2, the vehicle body W is sprayed with a top coat or overcoat in an amount so as to allow a film thickness of the top coat to exceed a sagging threshold value, namely, a maximum film thickness of the coat that does not cause sags. Conventional thermosetting paints usually have a sagging threshold value of about 40 μm; however, in the spraying step P2, the top coat is sprayed on the vehicle body W in an amount to form a film thickness, for example, as thick as 65 μm, that exceeds its sagging threshold value.

The vehicle body W with the top coat so sprayed is immediately conveyed from the spraying step P2 to the setting step P3. This setting step P3 is so constructed, as shown in FIG. 2(*a*) to (*i*), inclusive, that the vehicle body W is rotated in a horizontal direction, viz., about the rotational axis l extending in the horizontal direction. In this embodiment, the rotational axis l is designed to extend in the front and rear direction of the vehicle body W. Although ambient temperatures used in the setting step P3 are room temperature in this embodiment, they may be set in an appropriate range of temperatures, for instance, from 40° C. to 60° C., lower than temperatures used in the following baking step P4. It is to be noted that the setting step P3 is to cause low-boiling components of the top coat to evaporate prior to the baking step P4, thereby preventing such low-boiling overcoat components from evaporating rapidly in the baking step P4 and consequently causing no pinholes on the top coat surfaces.

In the baking step P4, the top coat on the vehicle body W is baked at ambient temperatures, for example, as high as 140° C. Like the setting step P3, this baking step P4 is conducted while the vehicle body W is rotated in the horizontal direction as shown in the sequence of FIG. 2(*a*) to (*i*).

The rotation of the vehicle body W in the horizontal direction as in the respective setting and baking steps P3 and P4 permits a coat to be dried without causing sags even if a paint is sprayed to form a film thickness exceeding a sagging threshold value. This can provide a coat surface of high quality with such a high degree of evenness as conventional coating methods could not provide.

Figure 3:
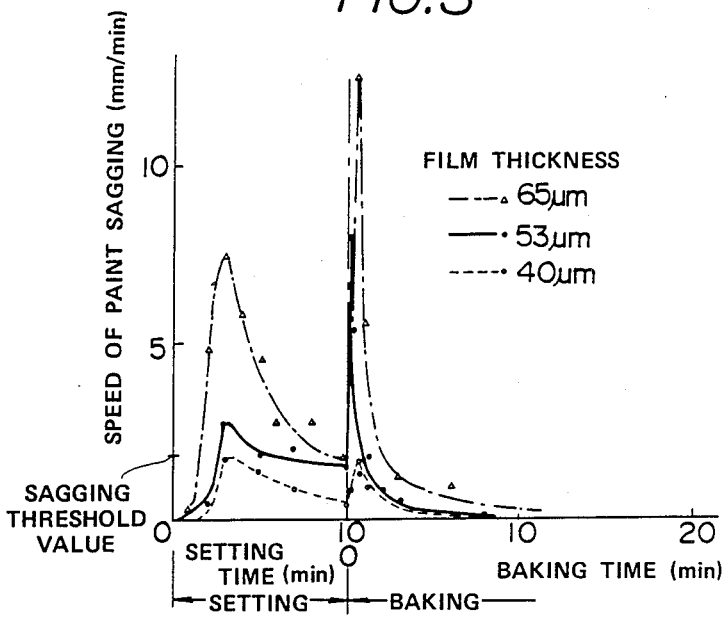
FIG. 3 is a graph showing the relationships of speeds of paint sagging and sagging threshold values vs. film thicknesses of coats and setting/baking times.

Relationships of Film Thickness with Sagging Threshold Value And of Degree of Evenness with Horizontal Rotation FIG. 3 shows influences of film thicknesses of a thermosetting paint over sagging threshold values. FIG. 3 takes film thickness of 40 μm, 53 μm and 65 μm as examples. In each case, a peak of sags has been recognized each at the early stages of both the setting step P3 and the baking step P4. A sagging threshold value is usually defined as a value at the time when sags are caused to occur at a rate ranging from 1 to 2 mm per minute. It is understood that, if sags would occur at a rate of 2 mm or more per minute when visually observed, coat surfaces are caused to be not good. By conventional methods using a conventional paint, the maximum film thickness that had ever obtained at a range below a sagging threshold value was as thin as about 40 μm.

Figure 4:
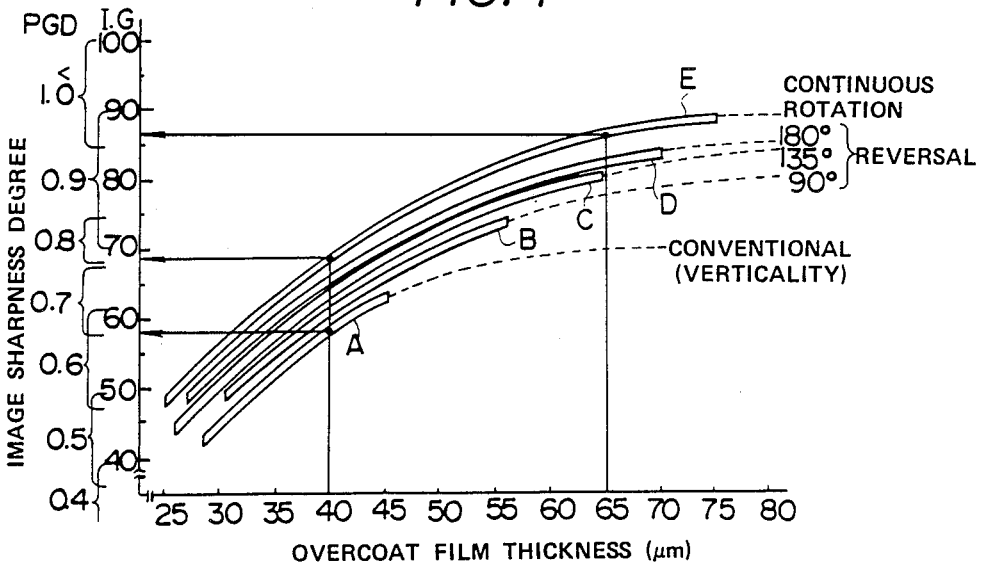
FIG. 4 is a graph showing the relationships of image sharpness degrees vs. overcoat film thicknesses and rotation degrees of a coating substrate.

FIG. 4 shows influences of horizontal rotations of the vehicle body W on degrees of evenness of top coats. In FIG. 4, reference symbol A denotes a state of a top coat coated using a conventional coating method where the vehicle body W is not rotated. Reference symbol B denotes a state of a top coat obtained by rotating the vehicle body W in a clockwise direction at 90° and then reversing it in a counterclockwise direction to the original position, namely, rotating it from the position of FIG. 2(*a*) through (*b*) to (*c*) and then reversing it from the position (*c*) through (*b*) back to (*a*). Reference symbol C denotes a state of a top coat obtained by rotating the vehicle body W at 135° and then reversing it to the original position, namely, rotating it from the position of FIG. 2(*a*) through (*b*) and (*c*) to (*d*) and then returning ti from the position of FIG. 2(*d*) through (*c*) and (*b*) back to the original position (*a*). Reference symbol D denotes a state of a top coat obtained by rotating the vehicle body W at 180° C. from the position of FIG. 2(*a*) through (*b*), (*c*) and (*d*) to (*e*) and then back to the original position of FIG. 2(*a*) through (*d*), (*c*) and (*b*) from (*e*). In FIG. 4, reference symbol E denotes a state of an overcoat obtained when the vehicle body W is rotated around in one way from the original position of FIG. 2(*a*) through (*b*), (*c*), (*d*), (*e*), (*f*), (*g*) and (*h*) back again to the original position of FIG. 2(*a*).

The vehicle body W may be rotated in one direction or rotated in one direction after another, in a continuous manner or in such an intermittent manner that it is rotated to a predetermined position and then suspended at that position. This operation may be repeated.

In order to control a paint sagging, the vehicle body W may be preferably rotated so as to return a coated surface from a vertical state to a horizontal state until the paint coated thereon flows to a length of 1 to 2 mm.

As the vehicle body W is rotated, a centrifugal force works on the sprayed coat, thus causing the coat to be sagged. Such a paint sagging is caused when a test piece of the coating substrate is rotated at 180° and then reversed at 180° for 0.25 second at a diameter of 30 cm, so that a speed of rotating the coating substrate is less than the speed caused the paint sagging on the test piece. Accordingly, a speed for rotating the vehicle body W may be 380 cm per second or less at the top end portion thereof, thus preventing paint sags from occurring by way of a centrifugal force, and the speed may not necessarily be constant. As the rotating radius of the coating substrate gets larger, the speed of rotation rotating radius of the coating substrate gets larger, the speed of rotation gets slower.

From the above, as shown in FIG. 3 a time required to cause the vehicle body W to be reversed at 180° or rotated at 90° up to the horizontal state may be preferably set from 0.25 second to 10 minutes. The speed of rotation may preferably from 6 r.p.m. to 600 r.p.m.

As is apparent from the results of FIG. 4, if a film thickness of a coat is identical to each other, a higher degree of evenness of the top coat is achieved when the vehicle body W is rotated, as shown by reference symbols, B, C, D and E in FIG. 4, than when it is not rotated, as shown by reference symbol A in FIG. 4. It is also noted that, in instances where the vehicle body W is rotated, the round rotation of the vehicle body W in one direction by 360° is preferred to provide a coat with a higher degree of evenness. It is further to be noted that, in instances where the vehicle body W is not rotated as in conventional manner, a film thickness of a coat is caused to be restricted to a certain value, thus leading to a limit on a degree of evenness.

A combination of the rotation of the vehicle body W in one direction with the subsequent reversal of the rotation thereof in the opposite direction may be preferably conducted in order to prevent the sprayed paint from collecting in irregular film thicknesses locally at corner portions formed by intersecting the surfaces extending in the rotational axis l. This operation permits a uniform coat on the surface of the vehicle body W.

To account for a degree of evenness on a coated surface, there is used herein an image sharpness degree that assigns a mirror surface on a black glass an I. G. (image gross) score of 100. By comparison, a film thickness of 65 μm, when formed by rotating the vehicle body W at 360, gets an 87 on the I.G. scale (the lower limit at a PGD value being 1.0), which means that the coated surface has 85% of the I.G. score on the mirror surface of the black glass. A film thickness of 40 μm scores a 58 (the lower limit at a PGD value being 0.7)

when formed without rotation of the vehicle body W while a 68 (the lower limit at a PGD value being 0.8) when formed by rotating it at 360. In the above definition, a PGD values stands for a degree of identification of a reflected image and is rated so as to be decreased from 1.0 as a degree of evenness gets lower.

The data shown in FIGS. 3 and 4 were obtained under the following test conditions:

(a) Paint: melamine alkid (black)
Viscosity: 22 seconds/20° C. (measured by Ford Cup #4)

(b) Film coater:
Minibell (16,000 r.p.m.)
Shaping air: 2.0 kg./cm$^2$ (c) Spraying amounts (two times):
First time: 100 cc/minute
Second time: 150–200 cc/minute (d) Setting time/temperature: 10 minutes/room temperature (e) Baking temperature/time: 140° C./25 minutes (f) Degree of undercoat evenness: 0.6 (PGD value) (intermediate coat over PE tape)

(g) Time period for rotation and reversal:
10 minutes (for the setting step)
10 minutes (for the baking step)

(h) Material to be coated: The side surfaces of a square pipe with a 30 cm side are coated and supported at its center rotatively.

(i) Rotational speed of the material to be coated: 6, 30 and 60 r.p.m. (No difference has in fact recognized at all.)

Carriage

The carriage D is provided with a mechanism for rotating the vehicle body W loaded thereon.

Figure 5:
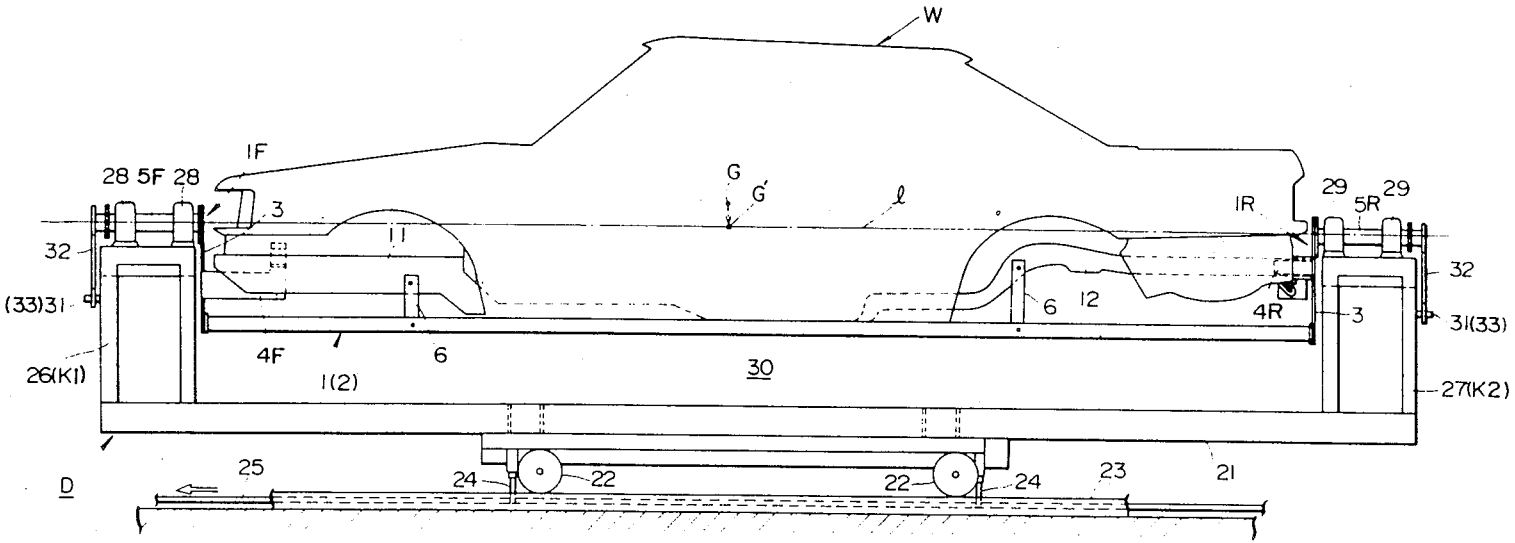
FIG. 5 is a side view illustrating one example of a carriage for conveying a vehicle body and a rotation device or jig.

Referring to FIG. 5, the carriage D is shown to include a base 21 and wheels, generally referred to as 22, running on rails 23, 23. From the base 21 extend a pair of stays 24 disposed at the front and rear positions, and a traction wire 25 is fixed to the stays 24. The traction wire 25 is designed to be driven by a motor (not shown) and thus to drive the carriage D.

On the base 21 are mounted a pair of boxes 26 and 27 at the front and rear end portions thereof (left and right end portions in FIG. 5). The boxes 26 and 27 are disposed to function as support portions for supporting the vehicle body W rotatively by a rotation device 1 as will be described more in detail hereinafter. On the tops of the boxes 26 and 27 are disposed bearing stands 28 and 29, respectively, in a fixed manner. A space between the pair of the boxes 26 and 27 is a supporting space 30 that is slightly wider than the total length of the vehicle body W and supports the vehicle body W.

Rotation Device

Figure 6:
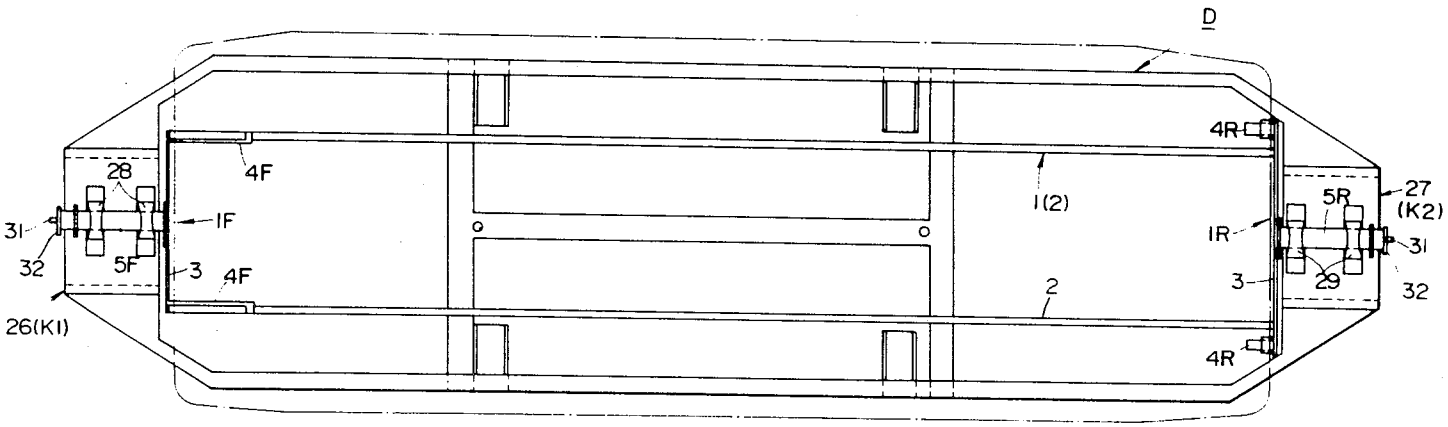
FIG. 6 is a plane view of the carriage and the rotation device in FIG. 5.

Referring to FIGS. 5 and 6, the rotation device or jig 1 is shown to include a front side portion 1F and a rear side portion 1R and a reinforcing connection portion 2 for connecting the front side portion 1F to the rear side portion 1R.

Figure 8:
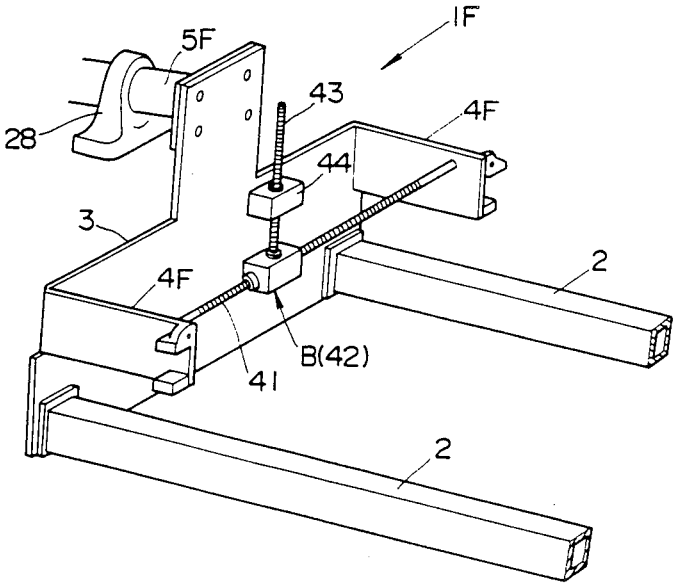
FIG. 8 is a perspective view of a front side portion of the rotation device.

As shown in FIG. 8, the front side portion 1F of the rotation device 1 is constructed to include a connecting portion 3 with both side portions bent in such a shape as shown in the drawing to form a pair of front mounting portions 4F, 4F. The connection portion 3 and the mounting portions 4F, 4F are formed from one sheet of an iron plate. To the extension portion of the connecting portion 3 is fixed a front rotation shaft 5F in a cylindrical shape by the welding or the like. The front rotation shaft 5F is supported rotatively by the box 26 through the bearing stand 28, and the rotation of the front rotation shaft 5F in the horizontal direction is transmitted to the front mounting portions 4F, 4F through the connecting portion 3. In this embodiment, the front end portions of a pair of front side frames 11, 11 (FIG. 5) disposed at the right and left sides of the vehicle body W are mounted detachably with bolts to the front mounting portions 4F, 4F of the rotation device 1.

The rear side portion 1R of the rotation device 1 is constructed in substantially the same manner as the front side portion 1F. For brevity of explanation, identical reference symbols and numerals used in the following description denote identical and like elements used for the front side portion 1F thereof and a description in duplicate will be omitted herein.

It is to be noted that a pair of rear mounting portions 4R, 4R of the rear side portion 1R are constructed in such a form as being inserted tightly into rear end openings of a pair of rear side frames 12, 12 disposed on the vehicle body W. A rear rotation shaft 5R is supported rotatively on the box 27 through bearing stands 29, 29. The front and rear rotation shafts 5F and 5R are designed so as to extend in a straight line and in a horizontal direction with the vehicle body W juxtaposed therebetween, and the axes of the front and rear rotation shafts 5F and 5R have each the rotational center l in common.

The reinforcing connection portion 2 of the rotation device 1 is fixed by welding or the like to the front side portion 1F and the rear side portion 1R. In this embodiment, the reinforcing connection portion 2 is composed of a pair of square hollow steel bars. As shown specifically in FIG. 8, the front and rear ends of the reinforcing connection portions 2, 2 are fixed to the front and rear side portions 1F and 1R at positions as close as possible to the front and rear mounting portions 4F and 4R, respectively. This construction permits the front and rear side frames 11 and 12 of the vehicle body W to be seated partially on the reinforcing connection portions 2 and 2, thereby supporting and sharing the weight of the vehicle body W with the mounting portions 4F and 4R. Each of the reinforcing connection portions 2, 2 is secured with bolts to the front side frame 11 and the rear side frame 12 through bracket 6, 6 mounted at positions away from the front and rear mounting portions 4F and 4R, respectively. This arrangement allows the vehicle body W to be mounted securedly and steady on the rotation device 1.

Balance Weight

The rotational axis l of the vehicle body W is preferably set so as to coincide with and pass through the gravitational center G obtained by a combination of the gravitational center of the vehicle body W with the gravitational center of the rotation device 1, as shown in FIG. 5. The coincidence of the rotational axis l with the center of gravity G can prevent a variation in a rotation of the vehicle body W. In instances where it is difficult to coincide the rotational axis l with the gravitational center G, a balance weight may be placed in a rotational axis system of the vehicle body W including the rotation device 1.

Turning now to FIG. 8, there is shown one example of a balance weight B, and it is shown that the front side portion 1F of the rotation device 1 is provided with a first balance weight 42 that is in turn disposed to be engageable with a first screw string 43. The both ends of the first screw string 41 are fixed to the front mounting portions 4F and 4F, respectively. To the frist balance weight 42 is fixed one end of a second screw string 43 extending in a direction perpendicular to the horizontal direction of the first screw string 41. A second balance weight 44 is disposed to be engageable with the second screw string 43.

By moving the first balance weight 42 along the first screw string 41 from one position to another in the horizontal direction, on the one hand, a position of the gravitational center G' of the rotational axis system comprising the vehicle body W, the rotation device 1 and the balance weight B in the breadthwise direction can be adjusted. By moving the second balance weight 44 along the second screw string 43 from one position to another in the vertical direction, on the other hand, a position of the gravitational center G' of the rotational axis system can be adjusted in the upward or downward direction. Furthermore, a movement of the first balance weight 42 in the circumferential direction about the first screw string 41 permits an adjustment of the positions of the gravitational center G' in the upward or downward direction by the second balance weight 44. It is noted there that the height of the first balance weight 42 is set in advance so as to allow the center of gravity G to pass through around the height of the first balance weight 42. This construction of the balance weight B enables the position of the gravitational center G' of the total rotational axis system to be adjusted so as to coincide with and pass through the rotational center 1.

The adjustment of the gravitational center G' of the rotational axis system may be made at appropriate timings prior to the start-up of the rotation of the vehicle body W. In this embodiment, this operation is carried out prior to the preparation step P1, viz., at the time when the vehicle body W is loaded on the carriage D at the loading step P7.

Outline of Rotation Driving

Referring to FIGS. 5 and 6, rotation driving units K1 and K2 are disposed in the boxes 26 and 27, respectively, as will be described more in detail hereinbelow. The rotation driving units K1 and K2 include each a spring as a driving source and an output shaft 31 extending toward outside the boxes 26 and 27, respectively. The output shafts 31, 31 are designed each to transmit a power from the driving source to the front or rear rotation shaft 5F or 5R through a transmitting mechanism 32 containing a sprocket and a chain.

The rotation driving units K1 and K2 will be described such that the rotation driving unit K1 is for the start-up and the rotation driving unit K2 is for the continuous rotation.

The rotation driving unit K1 for the start-up time may provide a torque necessary for the start-up of rotation, and the rotation driving unit K2 for the continuous rotation may enable the rotation of the vehicle body W as much as possible within a limited range of displacement of the spring.

Rotation Driving Unit K2

Figure 9:
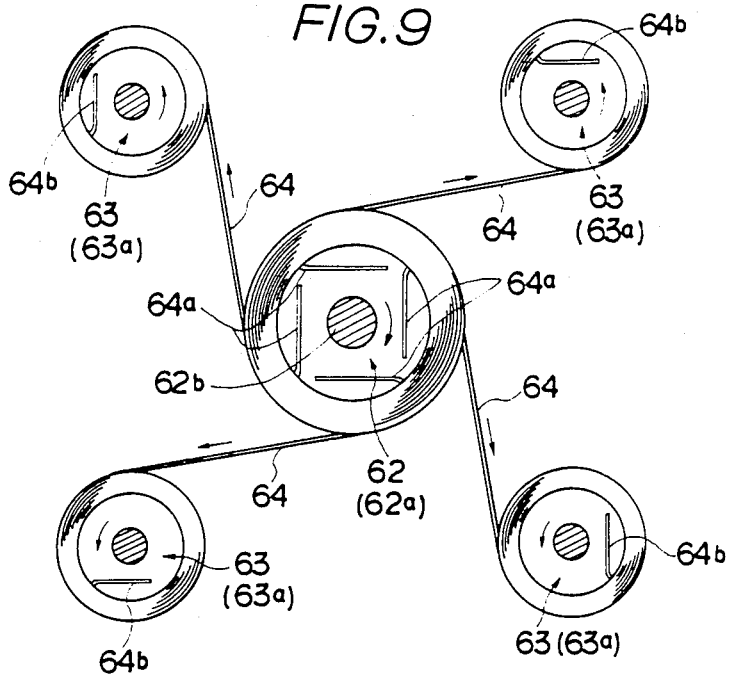
FIG. 9 is a front view illustrating the essential part of a spring for continuous rotation.
Figure 10:
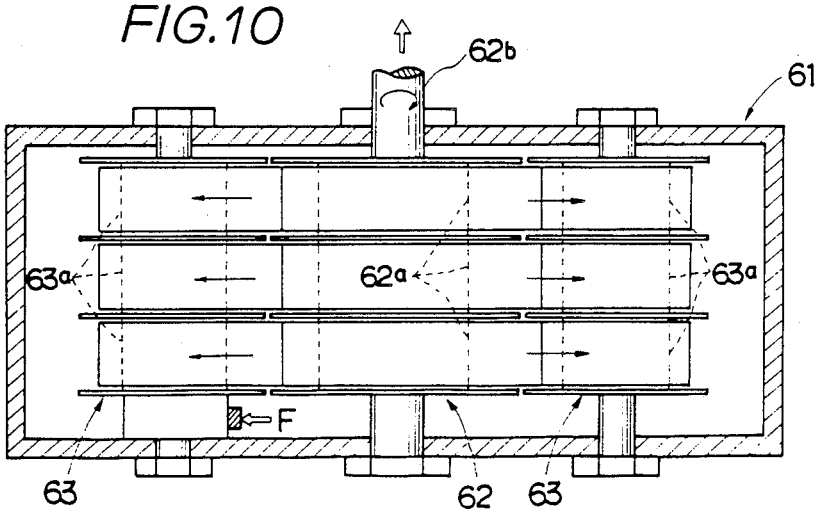
FIG. 10 is a partially cross-sectional plane view of the spring in FIG. 9 as seen from the top.

(a) Driving Source:

Referring to FIGS. 9 and 10, it is shown that the rotation driving unit K2 comprises a casing 61 that contains a force storing drum 62 and four of winding drums referred to generally as 63, each drum being supported rotatively on the casing 61. The four winding drums 63 are each constructed so as to be smaller in diameter than the force storing drum 62 and are disposed each at an equal distance and at the angle of 90° around the circumference of the force storing drum 62. Each of the force storing drum 62 and the four winding drums 63 is divided in axial directions with flanges into three drum portions, referred to generally as **62*a* and 63*a*, respectively. Between each of the drum portions 62*a* of the force storing drum 62 and each of the corresponding drum portions 63*a* of one of the four winding drums 63 is connected and wound an extensible thin-plate spring, referred to generally as 64. The one end 64*a* of the spring 64 is fixed to each of the drum portion 62*a* of the force storing drum 62 and the other end 64*b* thereof is fixed to each of the drum portions 63*a* of the winding drum 63. The same can be said of each of the drum portions 63*a* of the remaining drums 63. The four springs 64 extending from each of the four winding drums 63 are superimposed in four layers over the force storing drum 62**.

The spring 64 is designed so as to remain in a free state without a restoring force when it is wound on the drum portion **63*a* of the winding drum 63, on the one hand. When the spring 64 is wound on the force storing drum 62, on the other hand, the spring 64 is forced to be brought in such a state that the springing force is stored in the spring 64, namely, that the spring 64 generates the restoring force to go back to the original and free state. More specifically, as the spring 64 is wound on the force storing drum 62 and then released from the engagement with the force storing drum 62, the spring 64 is caused to generate the restoring force and rewound on the winding drum 63, thus driving the rotation of the force storing drum 62. The force storing drum 62 is also designed to serve as a mechanism of converting the restoring force of the spring 64** into a force of rotation to cause the rotation of the vehicle body W.

In this embodiment, the spring 64 is of a constant load type as capable of always generating a constant torque of the restoring force. Thus, as a constant load is applied to the force storing drum 62, a rotation shaft **62*b* of the force storing drum 62** is rotated at a constant speed.

Figure 11:
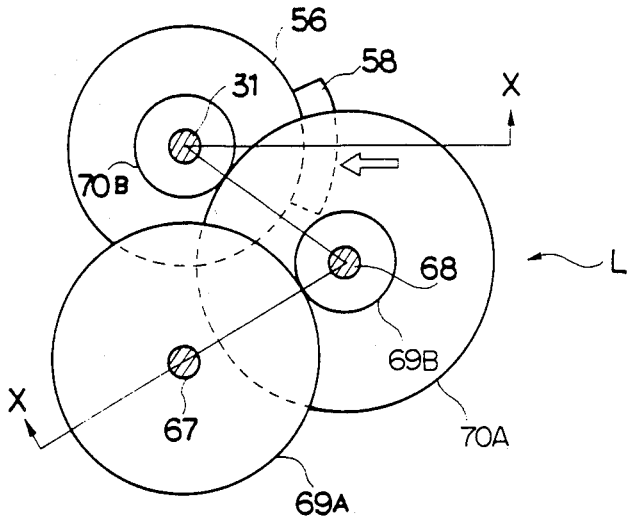
FIG. 11 is a diagrammatical plane view of an acceleration mechanism as seen from the axial direction.
Figure 12:
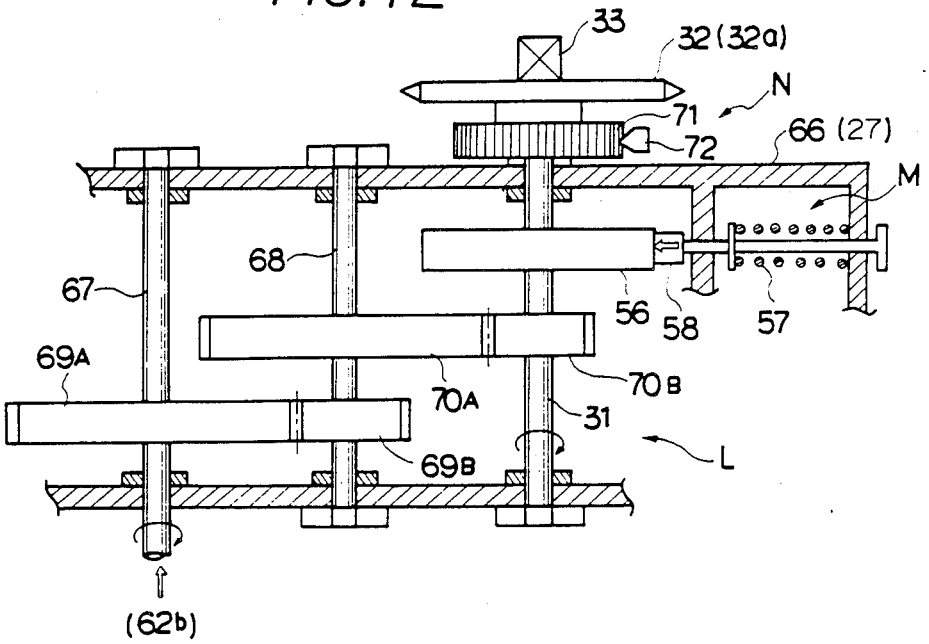
FIG. 12 is a partially cross-sectional plane view, as taken along the line X—X, of the acceleration mechanism in FIG. 11.

(b) Acceleration Mechanism L:

The rotation of the rotation shaft **62*b* of the force storing drum 62 is transmitted to the output shaft 31 through an acceleration mechanism L as shown in FIGS. 11 and 12**.

The acceleration mechanism L includes a casing 66 that is disposed nearby the casing 61 and constitutes a part of the box 27. The casing 66 supports rotatively the output shaft 31, an input shaft 67 and an intermediate shaft 68. The input shaft 67 is constructed so as to receive the rotational force transmitted by the rotation shaft **62*b* of the force storing drum 62. The rotation of the input shaft 67 is in turn transmittted to the intermediate shaft 68 through a train of accelerating gears 69A and 69B, and the rotation of the intermediate shaft 68 is further transmitted to the output shaft 31 through another train of accelerating gears 70A and 70B**.

(c) Constant Load Mechanism M:

As shown again in FIG. 12, a constant load mechanism M is arranged such that the output shaft 31 is mounted integrally with a braking drum 56 that is in abut with a shoe 58 urged by a spring 57. This structure of the constant load mechanism M comprising the braking drum 56, the spring 57 and the shoe 58 can produce a constant load corresponding to the force created by urging the spring 57, thereby allowing the rotation of the output shaft 31 based on the restoring force of the spring 64 as the source of rotation to be rendered more constant.

Figure 13:
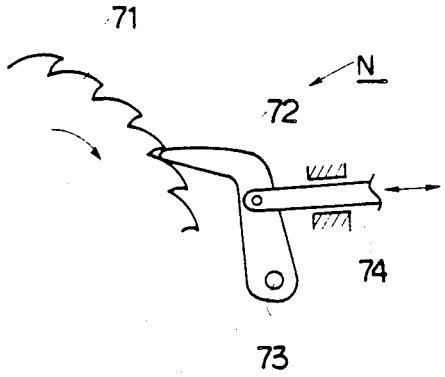
FIG. 13 is a diagrammatical side view illustrating the essential part of a ratchet mechanism.

(d) Ratchet Mechanism N:

Turning now to FIGS. 12 and 13, it is shown that the output shaft 31 is provided in a secured manner with a ratchet wheel 71 outside the casing 66 constituting part of the box 27. The ratchet wheel 71 is engageable with or disengageable from a ratchet pawl 72 that is supported pivotally about and by a pin 73 on the casing 66. The ratchet pawl 72 is disengaged from or engaged with the ratchet wheel 71 by operation of a lever 74 connected to the ratchet pawl 72. A clockwise direction of the rotation of the ratchet wheel 71 transmitted from the output shaft 31, as shown in FIG. 13, is a direction of the rotation created by the restoring force of the spring 64 as the rotation driving source. When the ratchet pawl 72 engages the ratchet wheel 71, the rotation of the output shaft 31 produced by the restoring force of the spring 64 is caused to stop. Accordingly, the rotation of the output shaft 31 can be kept going or brought to a stop in an arbitrary manner, for example, by manual operation of the lever 74.

In FIG. 12, reference numeral 32*a* denotes a sprocket that is fixed to the output shaft 31 and constitutes part of the transmitting mechanism 32, and reference numeral 33 denotes an engaging portion for rewinding the spring 64, as will be described hereinbelow.

(e) Ratchet Operating Mechanism O:

The ratchet mechanism N may be operted to be switched automatically at a predetermined position at which the carriage D is conveyed in such a manner as will be described bereinbelow.

Figure 14:
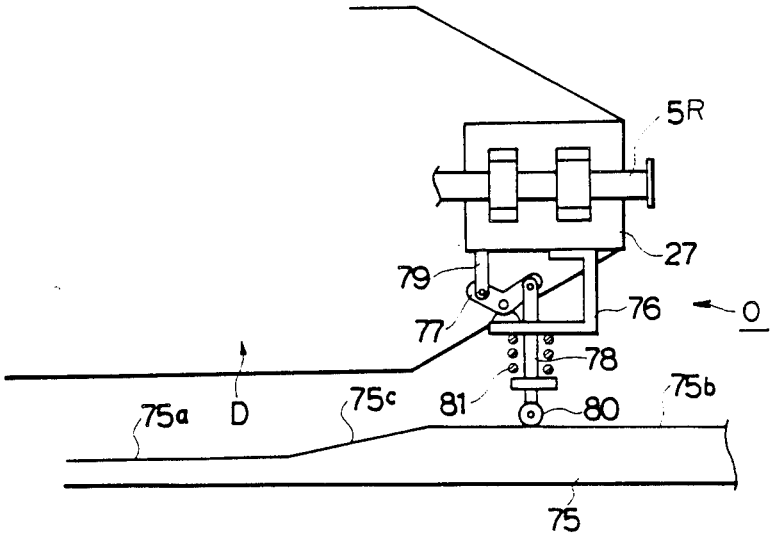
FIG. 14 is a plane view illustrating the essential part of the ratchet mechanism in FIG. 13 for an automatic operation.

Referring now to FIG. 14, the ratchet mechanism N is shown to be disposed in the box 27. A guide bar 75 is disposed in a secured manner along the locus of the conveyance of the carriage D. A surface of the guide bar 75 facing the carriage D includes a lowered surface 75*a*, an elevated surface 75*b* and a tapered surface 75*c* connecting in a smooth manner between the lowered surface 75*a* and the elevated surface 75*b*.

A bracket 76 fixed to the box 27 is supported pivotably by a bell crank 77 one end of which is connected to a base end portion of an input rod 78 and the other end of which is connected to an output rod 79 connected in turn to the lever 74. The input rod 78 is supported by the bracket 76 slidably in a direction perpendicular to the direction in which the carriage D is conveyed. The bottom tip of the input rod 78 is mounted relatively with a roller 80 as a follower, and a spring 81 is urged so as to allow the roller 80 to always come in abut with the guide bar 75.

With this arrangement, the position of the lever 74 can be adjusted by the vertical position of the roller 80 in abut with the guide bar 75. In this embodiment, when the roller 80 comes in abut with the lowered surface 75*a* of the guide bar 75, on the one hand, the force created by the spring 81 urged is caused to pull down the output rod 79 so that the lever 74 connected to the output rod 79 is kept in such a state as disengaging the ratchet pawl 71 from the ratchet wheel 72, thus allowing the rotation of the output shaft 31 to proceed. When the roller 80 comes in abut with the elevated surface 75*b* of the guide bar 75, on the other hand, the force created by urging the spring 81 acts on the input rod 78 so as for the lever 74 to cause the ratchet pawl 72 to engage the ratchet wheel 71, thereby causing the rotation of the output shaft 31 to stop.

Rotation Driving Unit K1

The rotation driving unit K1 joiurnaled in the box 26 will be described more in detail with reference to FIGS. 15 and 16. In the following description, the same elements as being used for the rotation driving unit K2 will be referred to by the same reference symbols and numerals, and such description will be omitted herefrom for brevity of explanation.

The arrangement for the spring 64 as the rotation driving source, the force storing drum 62 and the winding drum 63 for the rotation driving unit K1 is substantially the same as in the rotation driving unit K2 with the exception that the winding drum 63 and the spring 64 are disposed by only one and that the rotating force created by the restoring force of the spring 64 is applied to the rotation device 1 through a decelerating gear and a clutch.

A clutch plate 85*a* and a clutch drum 85*b* of a clutch 85 of a friction type are supported rotatively in the box 26. A gear 86 fixed on the outer periphery of the clutch plate 85;I a is arranged to engage with a gear 87 fixed on the rotation shaft 62*b* of the force storing drum 62. The gears 86 and 87 constitute a decelerating mechanism so that the gear 86 has a diameter larger than the gear 87.

The output shaft 31 functions as a clutch output shaft disposed in the clutch drum 85*b*. Accordingly, when the clutch 85 is connected, the rotation of the rotation shaft 62*b* of the force storing drum 62 produced by the restoring force of the spring 64 is decelerated and transmitted to the output shaft 31, thereby producing a large amount of torque necessary at the time of the start-up.

The clutch 85 is interposed for the purpose to disconnect the start-up spring 64 and the rotation device 1 immediately after the start-up of the rotation of the vehicle body W. As the restoring force of the start-up spring 64 is decelerated and transmitted to the output shaft 31, on the one hand, the spring 64 is designed so as to lose its restoring force fully by allowing the spring 64 to be thoroughly rewound on the winding drum 63, for example, as the vehicle body W is rotated nearly once. It is to be noted here, on the other hand, that, as the spring 64 for the continuous rotation is constructed to rotate the vehicle body W through the acceleration mechanism L, the spring 64 for the continuous rotation having the same length as the start-up spring 64 can rotate the vehicle body W at a number of revolutions, for example, 10 revolutions, greater than that of the start-up spring 64. The clutch 85 is disconnected after the start-up in order to cause the start-up spring 64 not to interfer with the rotation of the ehicle body W.

In this embodiment, the clutch 85 is designed so as to be automatically disconnected when the amount of the spring 64 wound thereon is detected to be nearly zero. The amount of the spring 64 wound on the force storing drum 62 may be detected by measuring a diameter of the drum 62 plus the spring 64 wound thereon.

Figure 15:
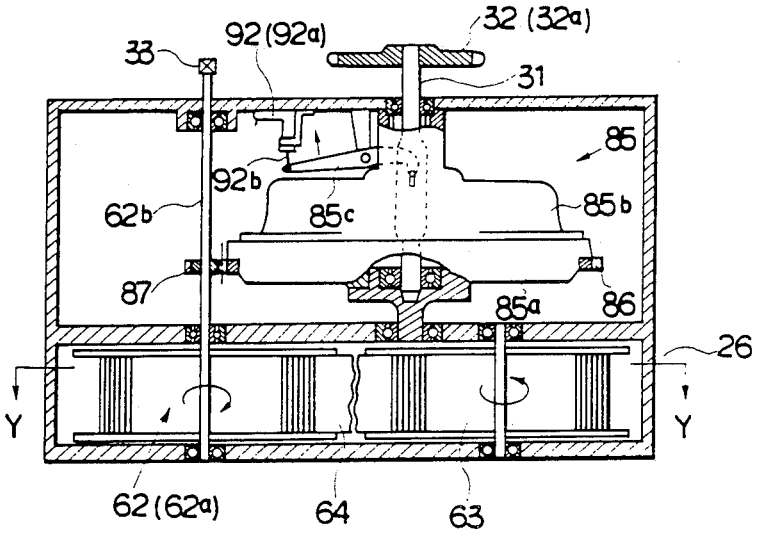
FIG. 15 is a partially cross-sectional plane view illustrating a spring for the start-up operation.
Figure 16:
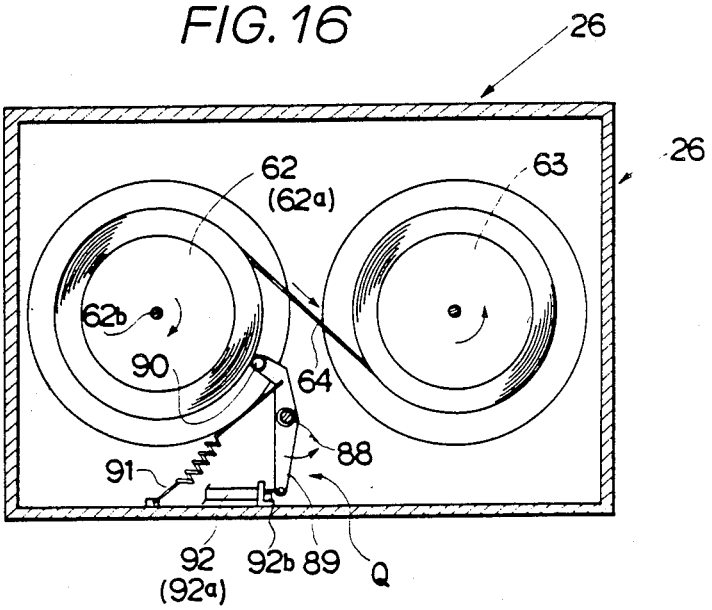
FIG. 16 is a partially cross-sectional plane view, taken along the line Y—Y line, of the spring in FIG. 15.

As shown in FIG. 16, the rotation driving unit K1 may be provided with a mechanism Q for detecting the amount of the spring 64 wound on the force storing drum 62. The mechanism Q is constructed in such a manner that a lever 89 is supported rotatively about a pin 88 in the box 26 and a spherical body 90 is mounted rotatively on the top tip portion of the lever 89. The lever 89 is urged by a spring 91 to come always in abut with the outer periphery of the force storing drum 62, viz., the outer circumferential surface of the spring 64 wound on the force storing drum 62. As shown in FIG. 15, to the lever 89 is connected a cable 92 that contains an outer tube 92*a* the both end portions of which are fixed to the box 26 and an inner wire 92*b* disposed inside the outer tube 92*a*. One end of the inner wire 92*b* is connected to the lever 89, and the other end of the inner wire 92*b* is connected to a clutch release lever 85*c*.

With this arrangement, the amount of the spring 64 wound on the force storing drum 62 is decreased to reach so nearly zero that the lever 89 is displaced and causes the clutch release lever 85*c* to be in turn displaced through the inner wire 92*b*, thus leading to the disconnection of the clutch 85.

Variants in Start-Up Springs

Figure 17:
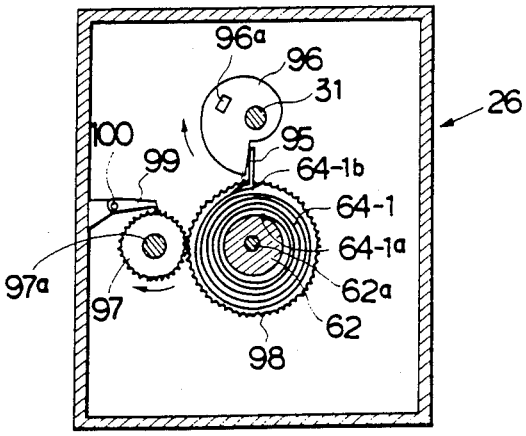
FIGS. 17 and 18 are each a partially cross-sectional plane view of another example of a spring for the start-up operation.

FIG. 17 illustrates an example of a variant in a start-up spring, in which a flat spiral spring 64-1 is used as the start-up spring. The flat spiral spring 64-1 is fixed at one end 64-1*a* to the force storing drum 62 and at the other end (free end) 64-1*b* to an engaging projection piece 95. Nearby the engaging projection piece 95 is disposed a cam piece 96 fixed to the output shaft 31. The flat spiral spring 64-1 is designed so as to have a restoring force to rotate the engaging projection piece 95 in the counter-clockwise direction, as shown in FIG. 17, as it is wound on the force storing drum 62. When the restoring force is given, the cam piece 96 is depressed by the engaging projection piece 95 to cause the output shaft 31 to rotate the vehicle body W. On the contrary, when the engaging projection piece 95 is rotated in the clockwise direction as shown in FIG. 17, on the other hand, it is virtually impossible to cause the engaging projection piece 95 to depress the cam piece 96, thus bringing the rotation of the rotation shaft 31 to a stop.

The rewinding of the flat spiral spring 64-1 on the force storing drum 62 is effected through a ratchet wheel 97 that is operatively coupled to the force storing drum 62 through a gear 98 engageable with the ratchet wheel 97. A ratchet pawl 99 is disposed to engage with the ratchet wheel 97 and fixed pivotally about a pin 100, thereby permitting movement of the ratachet wheel 97 in the clockwise direction only as shown in FIG. 17 and blocking movement in the direction opposite thereto.

The cam piece 96 is provided with a stopper hole 96*a* through which a stopper pin (not shown) is inserted to engage the cam piece 96 with the box 26. When the ratchet wheel 97 is provided with a rotational movement in the clockwise direction in FIG. 17 from the ouside in a state in which the cam piece 96 is engaged with the box 26, the flat spiral spring 64-1 is caused to be wound on the force storing drum 62 because a rotation shaft 97*a* of the ratchet wheel 97 is provided with a portion corresponding to the engaging portion 33 functioning as a portion for inputting an exterior force for rewinding. As the stopper pin was disengaged to release the flat spiral spring 64-1, the output shaft 31 is caused to be rotated utilizing the restoring force of the flat spiral spring 64-1 wound on the force storing drum 62. During the release, the ratchet wheel is being rotated in a free state.

Figure 18:
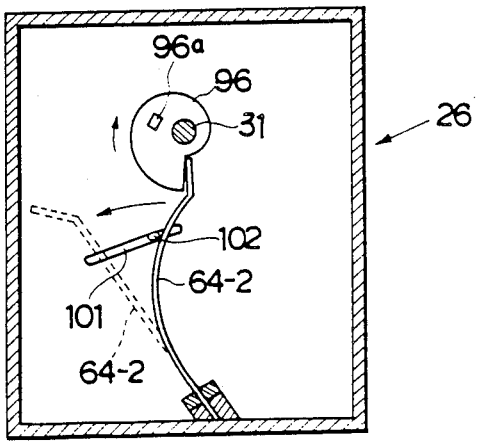

FIG. 18 shows another example of variants of start-up springs, in which the same elements as above are represented by the same reference numerals. In this embodiment, a flat spring 64-2 is used as a start-up spring. One end of the flat spring 64-2 is fixed to the box 26 and the other end (free end) is disposed to face the cam piece 96 in an abuttable manner. In FIG. 18, the flat spring 64-2 represented in the solid line demonstrates a state in which it has a restoring force while that represented in the broken line demonstrates a state in that its restoring force is released to the original state. The restoring force may be given the flat spring 64-2 by sliding the flat spring 64-2 with a pin 102. The pin 102 is inserted in a rectangular hole 101 formed on the box 26 and is disposed along the rectangular hole 101 to push the flat spring 64-2 slidably from the outside to a position at which the flat spring 64-2 engages the cam piece 96. As the flat spring 64-2 is disengaged from the cam piece 96, the restoring force is released to the position represented in the broken line in FIG. 18.

Stopper Mechanism R

A stopper mchanism R is to suspend the rotation of the vehicle body W at a predetermined rotational position and is used to stop the carriage D at a position suitable for unload the vehicle body W in the unloading step P5.

Figure 19:
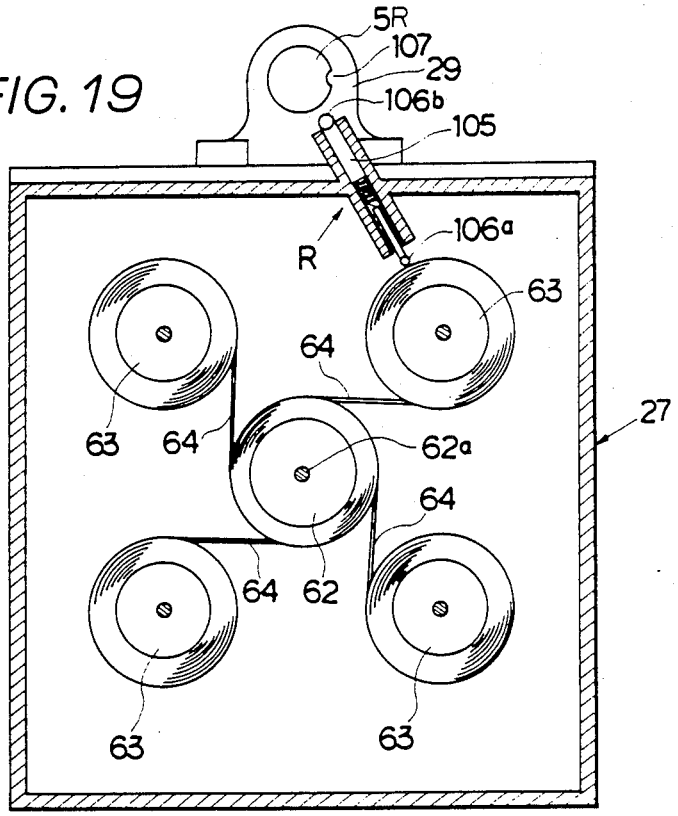
FIG. 19 is a partially cross-sectional plane view illustrating one example of a stopper mechanism for stopping the vehicle body at a predetermined rotational position.
Figure 20:
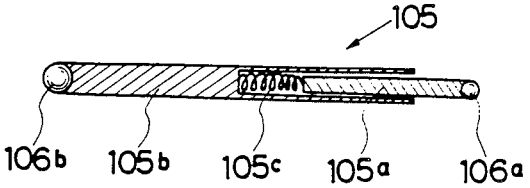
FIG. 20 is a cross-sectional view of a stopper rod to be used for the stopper mechanism in FIG. 19.

Referring to FIG. 19, it is shown that the stopper mechanism R contains a stopper rod 105 inserted slidably in the box 27. As shown specifically in FIG. 20, the stopper rod 105 comprises a pair of rods 105*a* and 105*b*, and the rod 105*b* has a hollow portion in which the rod 105*b* is inserted slidably. The rod 105*b* is provided at the bottom of its hollow portion with a spring 105*c* that is disposed to urge the rods 105*a* and 105*b* in extending directions. At the tip portions of the rods 105*a* and 105*b* are mounted relatively spherical bodies 106*a* and 106*b* as followers, respectively.

The spherical body 106*a* at the one tip of the stopper rod 105 is disposed to come in abut with the outer periphery of the winding drum 63, and the other spherical body 106*b* at the other tip of the stopper rod 105 is disposed to face the side surface of the rotation shaft 5R of the rotation device 1. The rotation shaft 5R is provided at the peripheral surface with an engging hollow 107.

With this construction of the stopper mechanism R, as an amount of the spring 64 wound on the winding drum 63 gets larger as the rotation of the vehicle body W proceeds, the increasing outer periphery of the winding drum 63 provides a growing pressure to the spherical body 106*a* at the one tip of the stopper rod 105, thus causing the spherical body 106*b* at the other tip of the stopper rod 105 to make an approach to the rotation shaft 5R. As the amount of the spring 64 wound on the winding drum 63 reaches a predetermined amount, the spherical body 106*b* of the stopper rod 105 is engaged with the engaging hollow 107 of the rotation shaft 5R, thereby suspending the winding of the spring 64 and consequnetly the rotation of the rotation device 1 leading to the suspension of the vehicle body W at a predetermined rotational position.

Figure 7:
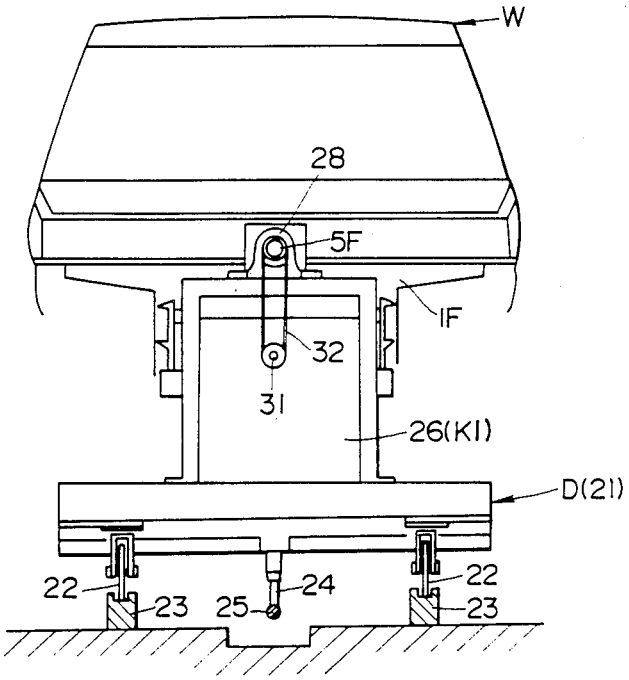
FIG. 7 is a left side view of FIG. 5.

In this embodiment, as the spherical body 106*b* is engaged with the engaging hollow 107, the vehicle body W is set to take a predetermined position as shown in FIGS. 5 and 7.

Variant in Stopper Mechanism R

Figure 21:
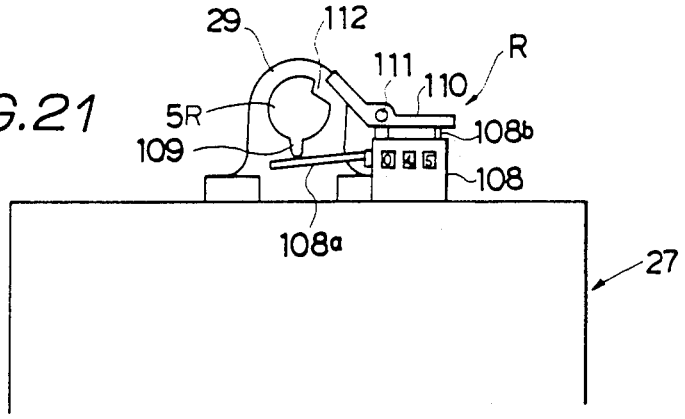
FIGS. 21 and 22 are a front view and a perspective view, respectively, illustrating another example of a stopper mechanism for stopping the vehicle body at a predetermined rotational position.
Figure 22:
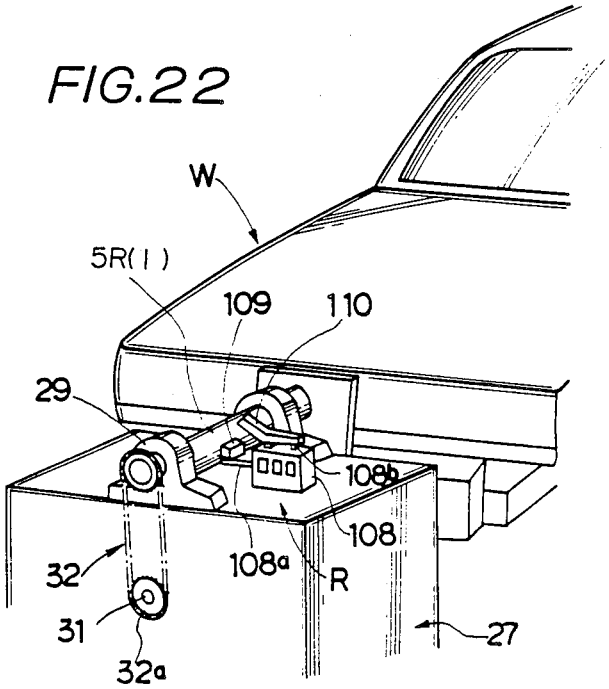

Turning now to FIGS. 21 and 21, the stopper mechanis R is shown to contain a counter 108 of the mechanical type fixed on the box 26 or 27. The counter 108 is of the type operatively counting numbers by moving a counting bar 108*b* in an upward or downward direction. For counting, the rear rotation shaft 5R of the rotation device 1 is provided on the side surface thereof with a projection piece 109 protruding therefrom. An engaging lever 110 is supported on the counter 108 pivotably about a pin 111.

As the counter 108 indicates a predetermined count, an operating piece 108*b* is disposed to protrude upwardly to push and turn the engaging lever 110 in the counterclockwise direction about the pin 111, as shown in FIG. 21. When the engaging lever 110 in the counterclockwise direction, it is then engaged with the engaging hollow 112 formed on the rear rotation shaft 5R leading to the suspension of the rotation of the rear rotation shaft 5R and consequently the vehicle body W.

Loading/Unloading Apparatus

Figure 24:
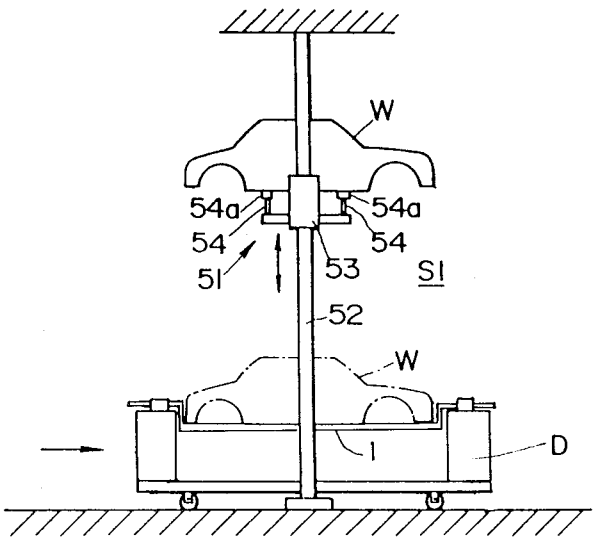
FIGS. 23 and 24 are a front view and a side view, respectively, illustrating one example of a loading/unloading apparatus for loading or unloading the vehicle body on the carriage.
Figure 23:
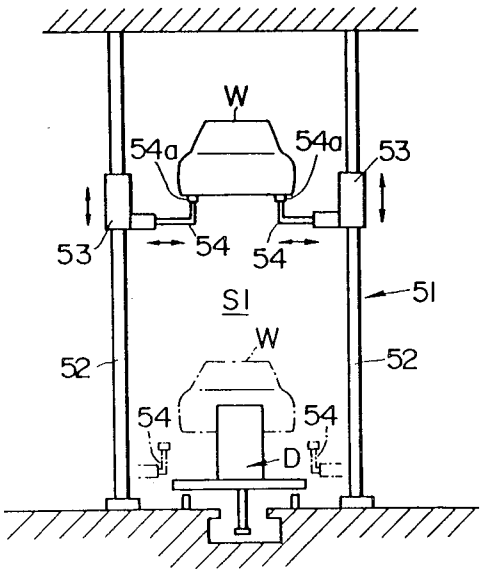
Figure 25:
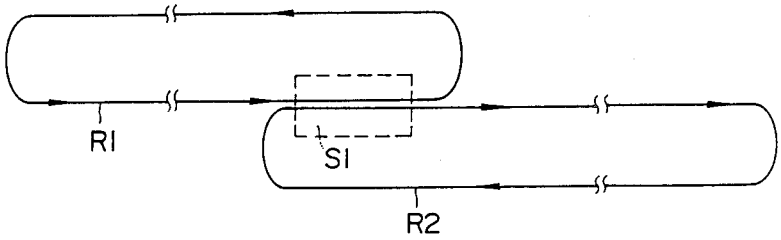
FIG. 25 is a diagrammatical plane view showing the locus of the conveying carriages.

A loading/unloading apparatus is to load the vehicle body W on the carriage D in the loading step P7 and unload the vehicle body W from the carriage D in the unloading step P5. FIGS. 23 to 25 represent one example of such an apparatus.

As shown in FIG. 25, the loading/unloading apparatus is disposed in a loading/unloading station S1 where the locus R1 of conveyance of carriages in the coating line is approaching to the locus R2 of conveyance of carriages or hangers in the assembly line.

The loading/unloading appartus in this embodiment will be described as an example in which it is used in the unloading step P5. It is thus to be understood that, although the loading/unloading apparatus used merely in the unloading step P5 will be referred to herein as an unloading apparatus, this may also be used generally for the loading purposes in the loading step P7.

The unloading apparatus comprises basically a lifter 51, and the lifter 51 comprises a pair of guide posts 52, 52 with a supporting base 53 mounted on each of the guide posts 52, 52 in such a manner as operatively moving upwardly or downwardly. The supporting base 53 is provided with a supporting arm 54 that is driven so as to extend or contract in a horizontal direction. The supporting arm 54 is provided with a pair of supporting portions 54*a* at separate positions along the line of the conveyance of the carriage D.

With the arrangement of the unloading apparatus in the unloading step P5, the carriage D with the vehicle body W loaded thereon is conveyed from the baking step P4 to the unloading step P5 and then stopped at the loading/unloading station S1. As the carriage D suspended, the supporting arms 54, 54 are extended from the supporting bases 53, 53 disposed at lower positions of the guide posts 52, 52, and the supporting bases 53, 53 are operated to move upwardly to allow the supporting portions 54*a*, 54*a* to support the side sills or floor frame portions of the vehicle body W, then lift up the vehicle body W from the carriage D and raise it to a higher position. The carriage D is conveyed to the rewinding step P6 and instead a carriage D to be used in the assembly line is then conveyed to the loading/unloading station S1.

The supporting bases 53, 53 with the vehicle body W supported thereon are then lowered to load the vehicle body W on the carriage D for the assembly line, and the supporting arms 54, 54 are shortened to unload the vehicle body W.

The loading of a freshly overcoated vehicle body W on the carriage D in the loading step P7 is effected in substantially the order opposite to the order of the unloading step P5.

It is preferred that the carriage D is held tightly at the predetermined position by using, for example, a positioning apparatus for clamping the carriage D from the front and rear and the left-hand and right-hand directions while the vehicle body W is loaded or unloaded. The loading/unloading apparatus may have hangers at an upper position which are constructed so as to be conveyed intermittently. In this case, the vehicle body W may be shifted from the lifter 51 to the hangers, and the hangers then raise the vehicle body W and convey it above a carriage for the assembly line. The vehicle body W is then shifted again from the hangers to another lifter that is in turn conveyed to the carriage for the assembly line.

Rewinding Mechanism T

A rewinding mechanism T is to store the restoring force within the spring 64 (64-1 and 64-2). In this embodiment, the rewinding mechanism T is disposed on a passage of conveying carriages D in a nonexplosive zone immediately prior to the loading of non-overcoated vehicle bodies W on the carriages D.

Figure 26:
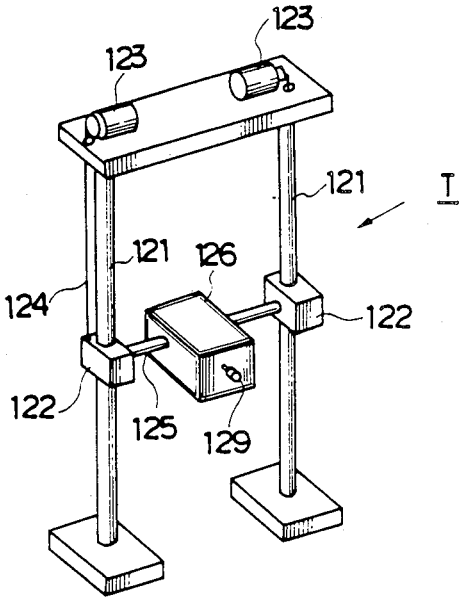
FIGS. 26 and 27 are a perspective view and a side view illustrating one example of a force storing apparatus for applying a restoring force to the spring for the rotation.
Figure 27:
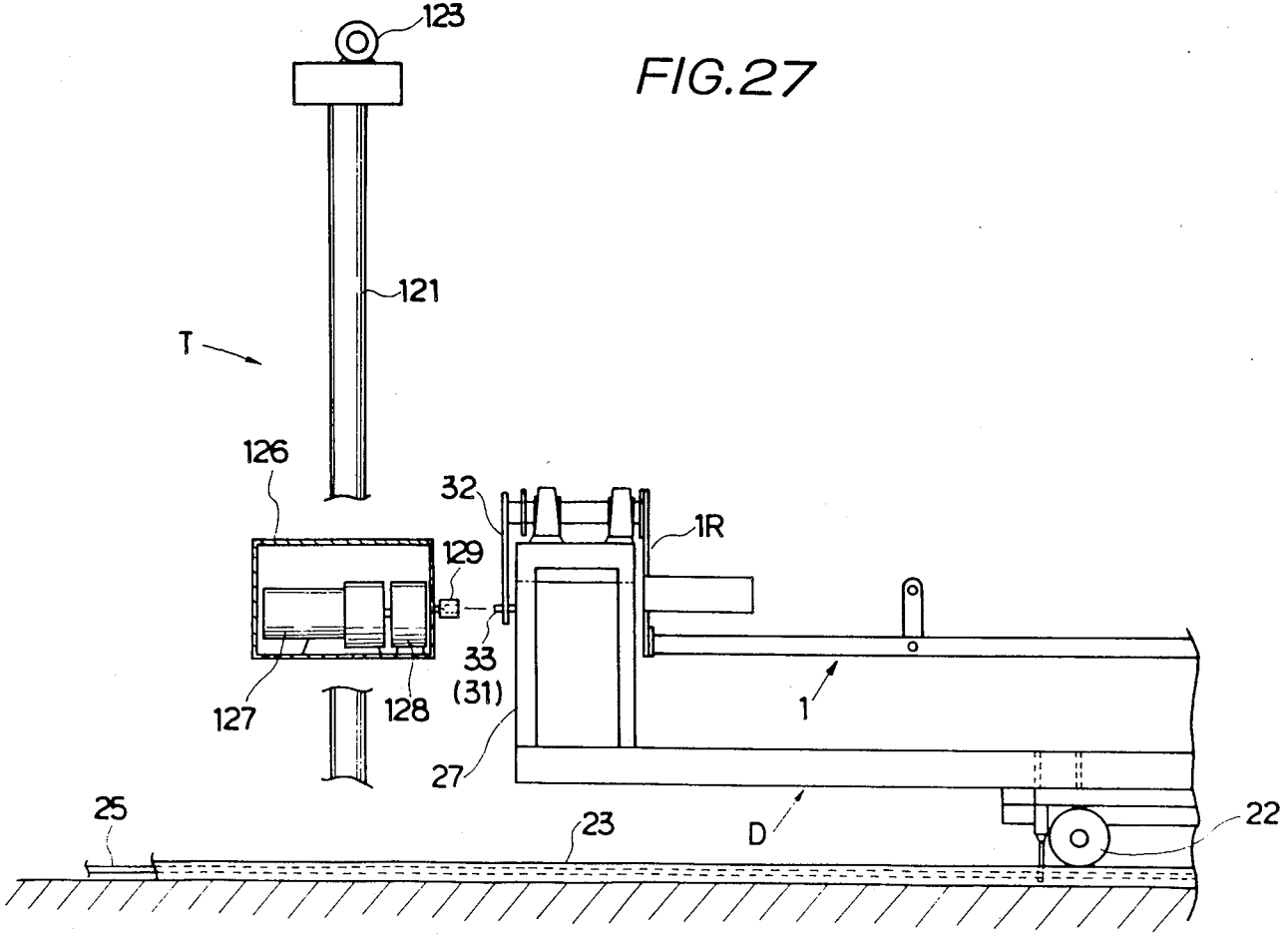

Referring to FIG. 26, the rewinding mechanism T is shown to include a pair of left and right guide posts 121, 121 with a slider 122 disposed on each of the guide posts 121, 121 slidably in an upward or downward direction. The slider 122 is moved upwardly or downwardly by a motor 123 through a wire 124. Between the left and right sliders 122, 122 is bridged a holding bar 125, and a casing 126 is fixed on the midway of the holding bar 125. As shown in FIG. 27, an air motor 127 and a decelerator 128 are disposed in the casing 126. An output shaft 128*a* of the decelerator 128 extends towards outside the casing 126 and an engaging box 129 is fixed to the tip portion of the output shaft 128*a*.

With this arrangement, as shown in FIG. 27, as a carriage D approaches from the unloading step P5 to the rewinding step P6, the casing 126 is being lowered to the carriage D. Then the carriage D is caused to approach until the engaging portion 33 for the rewinding purpose disposed on the carriage D is caused to engage with the engaging box 129. Thereafter the motor 127 is driven to rotate the engaging portion 33 in order to rewind the spring 64 for producing the restoring force therewithin.

After the spring 64 was rewound on the force storing drum 63, the carriage D is once returned back toward the unloading step P5 to disengage from the engaging box 129 and then the casing 126 is raised in an upward direction to allow the carriage D to convey through the left and right guide posts 121, 121 to the coming loading step P7.

The rewinding mechanism T may be designed such that an actuator for the exclusive use is disposed separately or that a displacement of the carriage D against the rails 23, 23 is utilized. In this case, for example, a rack bar is disposed in a fixed manner along the locus of the conveyance of the carriage D by a predetermined length while the carriage D is provided rotatively with a gear engageable with the rack bar, whereby the spring 64 is caused to be rewound in association with the rotation of the gear (for instance, a connection between a gear and the force storing drum 62 utilizing a wire and the drum on which the wire is wound). It is a matter of course that the rack bar is disposed by a length corresponding to the number of revolutions of the gear necessary for storing the restoring force. The rack bar may be mounted at a few positions along the locus of the conveyance of the carriage D, for example, immediately prior to the steps P1, P2 and P3. With this arrangement, it is advantageous that lengths of the springs 64 used in the embodiments as shown in FIGS. 9 and 10 may be shortened.

Variants in Rotation Driving Unit K2

Figure 34:
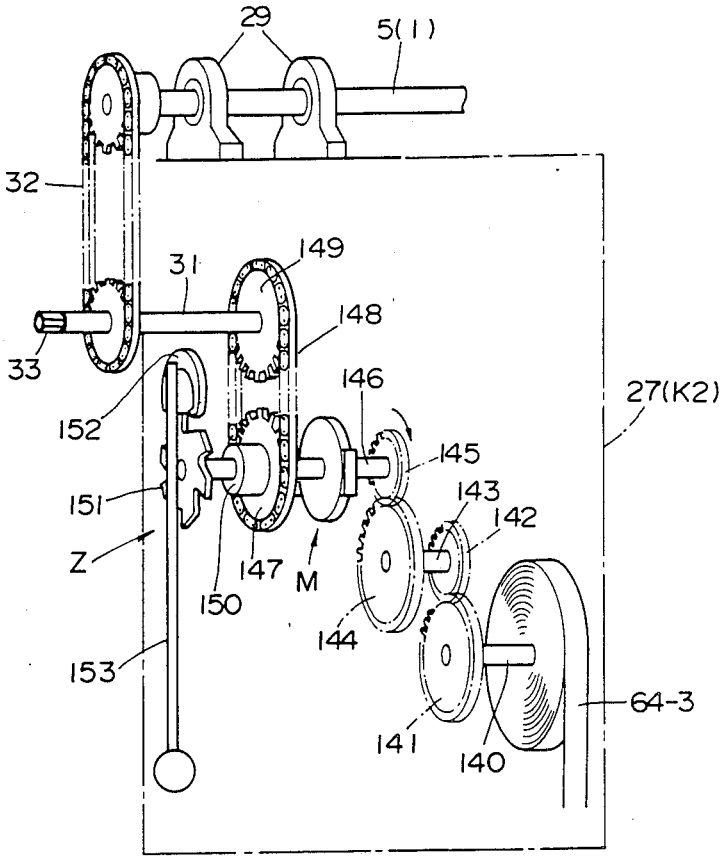
FIG. 34 is a diagrammatical perspective view illustrating a variatnt in a driving unit.

FIG. 34 shows another example of variants in rotation driving units K2, in which a spiral spring 64-3 is used as the spring and a speed governing mechanism Z.

One end of the spiral spring 64-3 is fixed to the box 27 and the other end thereof is fixed to a rotation shaft 140. The rotation of the rotation shaft 140 is transmitted through the sequence of a gear 141, a gear 142, a shaft 143, a gear 144, a gear 145, a shaft 146, a cam clutch 150, a sprocket 147, a chain 148 and a sprocket 149 to the output shaft 31.

The cam clutch 150 is designed so as to transmit only the rotation of the shaft 146 in the arrow direction in FIG. 34 to the sprocket 147, corresponding to the rotational direction based on the restoring force of the spring 64-3. On the shaft 146 is mounted a constant load mechanism M of the type similar to that shown in FIG. 12.

Figure 35:
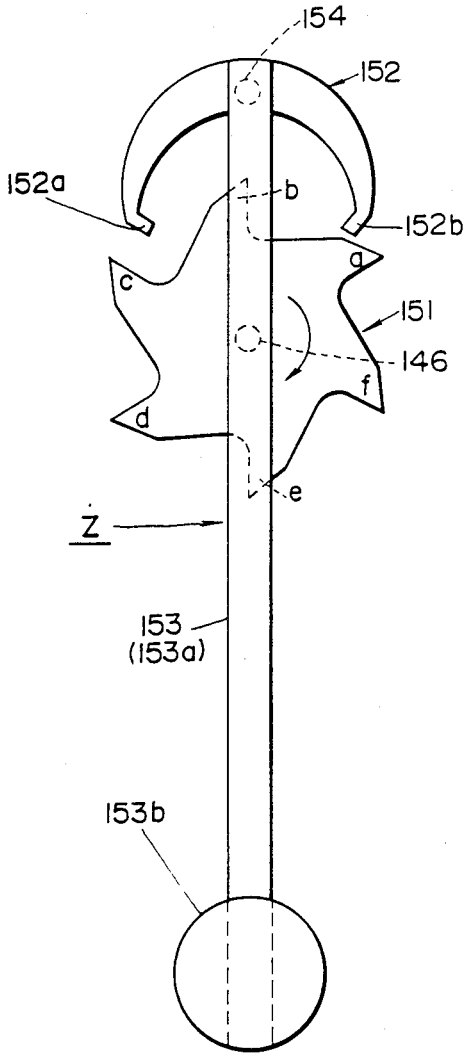
FIG. 35 is a front view illustrating one example of a speed governing mechanism.
Figure 36:
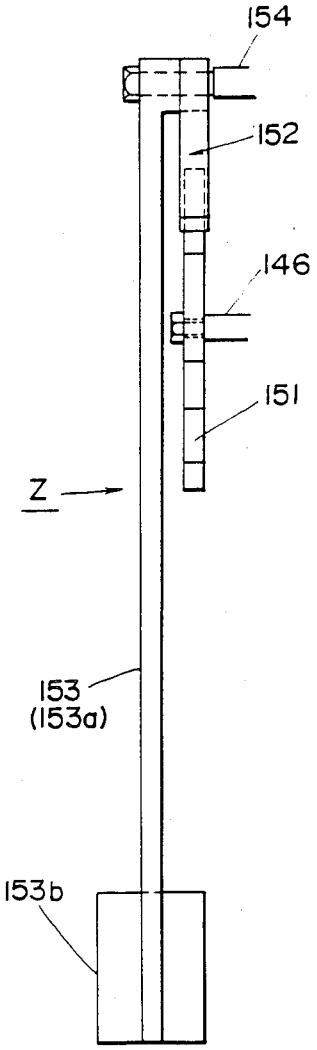
FIG. 36 is a right side view of FIG. 35.
Figure 37:
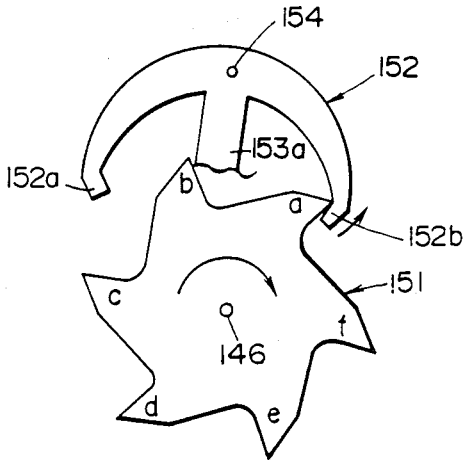
FIG. 37 to FIG. 40 are each a plane view illustrating an action of the speed governing mechanism.
Figure 38:
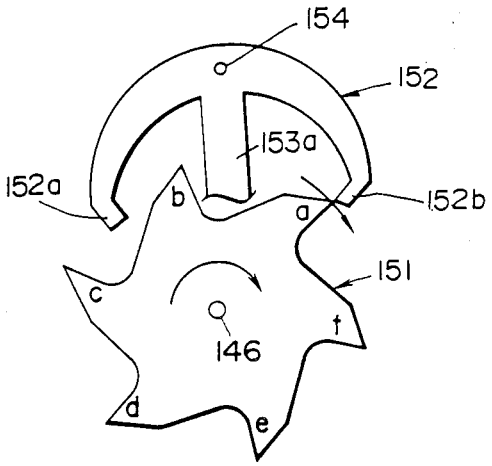
Figure 39:
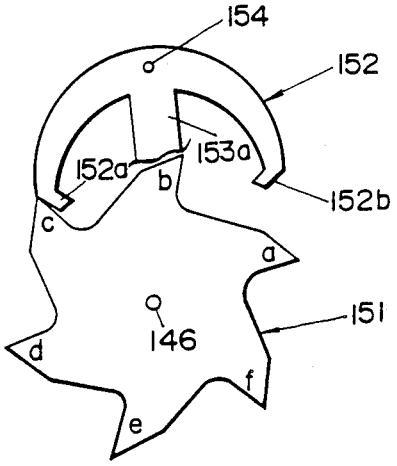
Figure 40:
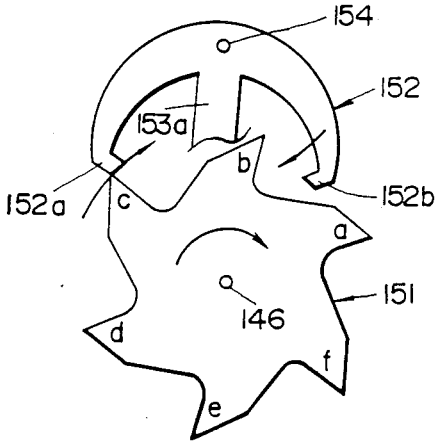

The speed governing mechanism Z is shown to contain a jaw gear 151, a feed jaw 152 and a pendulum 153. As shown specifically in FIGS. 35 and 36, the jaw gear 151 is fixed to one end of the shaft 146. As shown more specifically in FIGS. 37 to 40, the jaw gear 151 is provided with six jaw portions a to f, inclusive, at equal distances on the outer periphery. The feed jaw 152 is disposed to engage with the jaw gear 151 and a pair of left and right jaw portions **152*a* and 152*b* thereof and connected pivotally about a shaft 154. The pendulum 153 is shown to contain a supporting arm 153*a* with its upper end portion fixed pivotally about the feed jaw 152 and a weight 153*b* mounted at the bottom end of the supporting arm 153*a*. The speed governing mechanism Z rotates the shaft 146 at constant speeds by a pivoting cycle determined by the pendulum 153 and the application of the rotating force from the springs 64-3 in a predetermined direction, for example, in the clockwise direction in FIGS. 37 to 40. The order of operating the jaw gear 151 and the feed jaw 152 is from FIG. 37 through FIGS. 38 and 39 to FIG. 40. After FIG. 40, the jaw gear 151 and the feed jaw 152 proceed to FIG. 37, and the operation is continuously repeated in the identical order. More specifically, as shown in FIG. 37, the jaw portion a of the jaw gear 151 is engaged with the right jaw portion 152*a* of the feed jaw 152. The feed jaw 152 is then operated to rotate the right jaw portion 152*a* pivotally about the shaft 154 in the counterclockwise direction to disengage the jaw portion a of the jaw gear 151 with the right jaw portion 152*b*. As the feed jaw 152 proceeds to rotate, the right jaw portion 152*a* is disengaged from the jaw portion a of the jaw gear 151 as shown in FIG. 38. Then the jaw gear 151 is allowed to rotate in the clockwise direction. The clockwise rotation of the jaw gear 151 is caused to suspend as the feed jaw 152 is kept on rotating about in the counterclockwise direction and the left jaw portion 152*a* is allowed to engage the jaw portion c of the feed jaw 151 as shown in FIG. 39. The feed jaw 152 is then pivoted in the clockwise direction disengaging the jaw gear 151 from the left jaw portion 152*a* and allowing the jaw gear 151 to rotate in the clockwise direction as shown in FIG. 40. The feed jaw 152 is further pivoted in the clockwise direction to cause the right jaw portion 152*b* to engage the jaw portion b of the jaw gear 151 in a state as shown in FIG. 37. In summary, the jaw gear 151** is designed so as to proceed to rotate by one jaw portion only from one jaw portion to another following thereafter.

Figure 41:
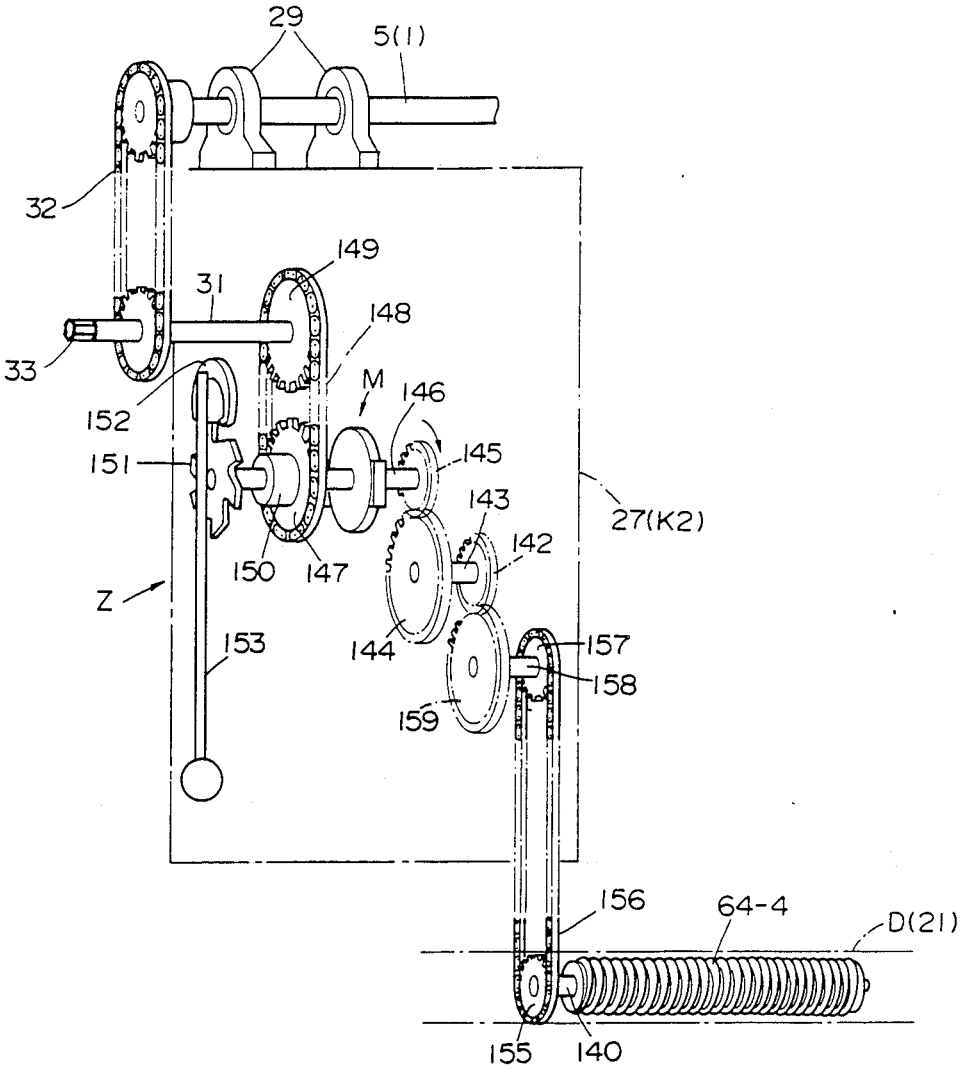
FIG. 41 is a diagrammatical perspective view illustrating a variant in a driving unit.

FIG. 41 shows a further example of variants in rotation driving units K2, in which the same elements as those in FIG. 34 are represented by the same reference numerals. The rotation driving unit K2 is shown to use a torsion spring coil 64-4 wound on the shaft 140 as the spring. One end of the torsion spring coil 64-4 is fixed to the box 27 and the other end thereof is fixed to the shaft 140. The rotation of the shaft 140 is designed so as to be transmitted from a sprocket 155 through another sprocket 157 to a gear 159. The sprocket 155 is connected to the sprocket 157 with a chain 156, and the sprocket 157 is in turn connected to the gear 159 with a shaft 158. The gear 159 is further arranged to engage with the gear 142 and the rotation transmitted to the gear 142 is kept on being transmitted to the rotation shaft 5 of the rotation device 1 in the same manner as shown in FIG. 34. By using the chain 156, the torsion spring coil 64-4 of a long length may be disposed at a low position like under the supporting base 21 of the carriage D.

Torque Switching Means

A spring as a source for driving rotation may be of a type capable of being employed for both the start-up and the continuous rotation. The spring may be disposed at either of the front and rear positions only, thereby applying a rotating force to the vehicle body W from one of the front and rear sides only. In the case that there is employed the spring of the type usable for both the start-up and the continuous rotation, the restoring force produced by the spring may be designed so as to be transmitted to the vehicle body W through a transmission by causing deceleration at the time of the start-up and acceleration after the start-up by the transmission.

Figure 42:
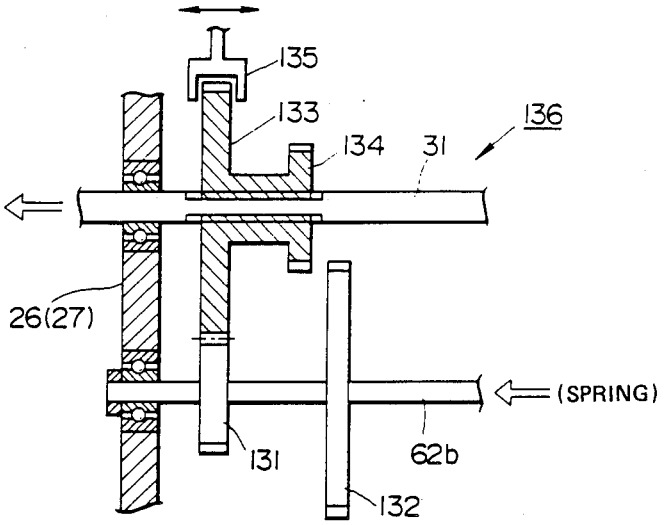
FIG. 42 is a partially cross-sectional side view illustrating one example of a torque switching means.

FIG. 42 shows an example of such torque switching transmission 136. A smaller-size gear 131 and a larger-size gear 132 are fixed on the rotation shaft **62*b* rotatable subject to the restoring force of the spring 6, and an integral set of a larger-size gear 133 and a smaller-size gear 134 is fitted to the output shaft 31 in a spline manner. By operatively moving a lever 135 in the arrow direction to the position in FIG. 42 where the larger-size gear 133 is caused to engage the smaller-size gear 131, on the one hand, the rotation of the rotation shaft 62*b* is allowed to be transmitted to the output shaft 31 in a decelerating manner, thereby securing a large amount of torque for the start-up. By operatively moving the lever 135 in the right-hand direction in FIG. 42 to the position where the smaller-size gear 134 is caused to engage the larger-size gear 132, on the other hand, the rotation of the rotation shaft 62*b* is accelerated and transmitted to the output shaft 31, thereby securing a small amount of torque for the continuos rotation. The displacement of the lever 135 may be conducted by means of a mechanism as shown in FIG. 14**.

As the torque switching mechanism as described above can render the torque transmitted from the spring to the coating substrate such as the vehicle body W larger at the build-up time of the rotation than subsequent to the build-up time, it can permit a secure start-up of the rotation of the coating substrate and make an amount of displacement of the spring required per revolution of the coating substrate smaller after the start-up of the rotation, thus enabling the coating substrate to be rotated as much as possible within a limited range of the amount of displacement of the spring.

Variants in Rotation Devices

Figure 43:
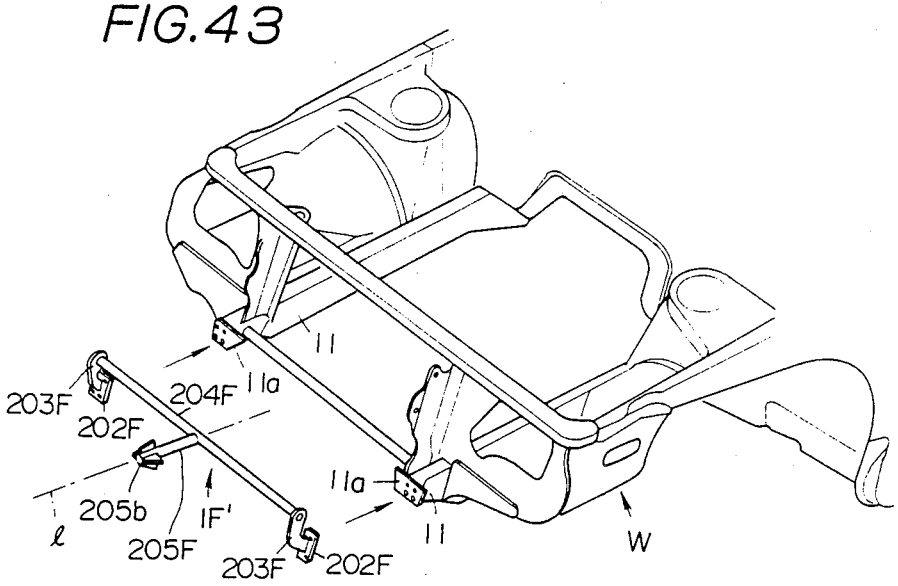
FIG. 43 is a perspective view illustrating an example of connection of the rotation device shown in FIGS. 28 to 33 to the front portion of the vehicle body.

FIG. 43 shows a front rotation device 1F' to be mounted on the front side of the vehicle body W. The front rotation device 1F' is shown to include a pair of left and right mounting brackets 202F, 202F, a pair of left and right stays 203F, 203F welded to each mounting bracket 202F a bar 204F connected integrally between the left and right stays 203F, 203F, and a rotation shaft 205F welded to the bar 204F. The front rotation device 1F' may be fixed through the brackets 202F, 202F to a front reinforcing member of the vehicle body W such as the front side frames 11, 11. The front side frames 11, 11 are usually provided with brackets **11*a*, 11*a* for mounting a bumper (not shown) so that the brackets 202F, 202F may be fixed detachably with bolts (not shown) to the brackets 11*a*, 11*a*** on the side of the vehicle body W.

Figure 44:
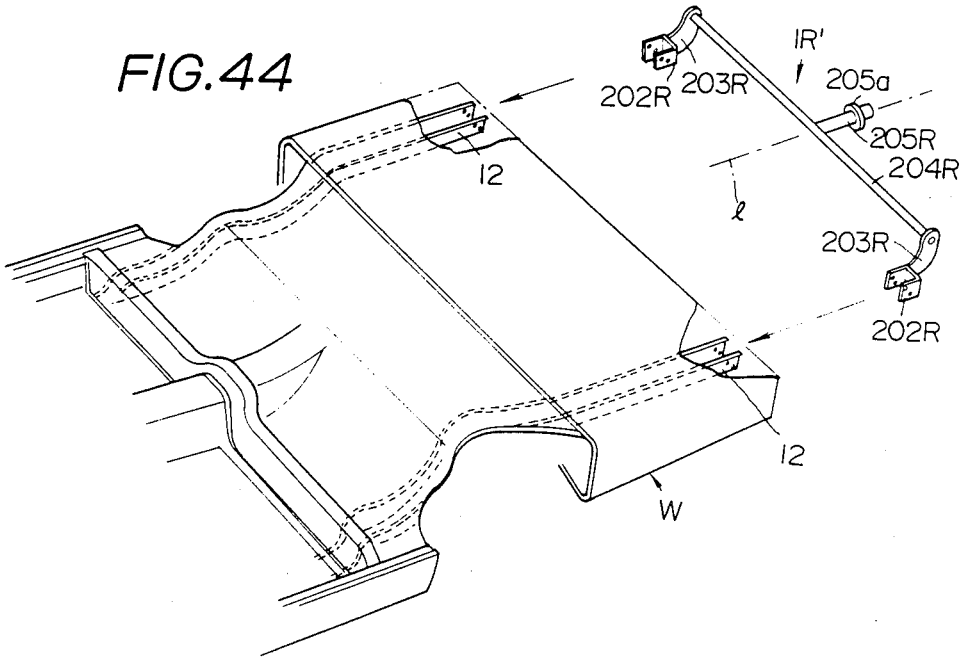
FIG. 44 is a perspective view illustrating an example of connection of the rotation device shown in FIGS. 28 to 33 to the rear portion of the vehicle body.

A rear rotation device 1R' to be mounted on the rear side of the vehicle body W is shown in FIG. 44 and is constructed in substantially the same manner as with the front rotation device 1F'. The same elements as those in the front rotation device 1F' will be represented by the same reference symbols and numerals and the reference symbol "R" after the reference numerals is used in the following description instead of "F" as long as the context is interpreted so as to cause no contradiction. The rear rotation device 1R' is fixed detachably through the brackets 202R, 202R of the rear rotation device 1R' to the rear side frames 12, 12 at the rear portion of the vehicle body W as a rear reinforcing member. As the rear side frames 12, 12 are usually welded in advance with brackets for mounting bumpers, the rear rotation device 1R' may be mounted through the brackets fro mounting the bumpers.

The front and rear rotation devices 1F' and 1R' are disposed in a state of being mounted to the vehicle body W to cause the front and rear rotation shafts 205F and 205R to be located in a straight line so as to allow this line to coincide with the axis of rotation l.

The front and rear rotation device 1F' and 1R' may be prepared for exclusive uses according to kinds of vehicle bodies.

Variants in Carriages

Figure 45:
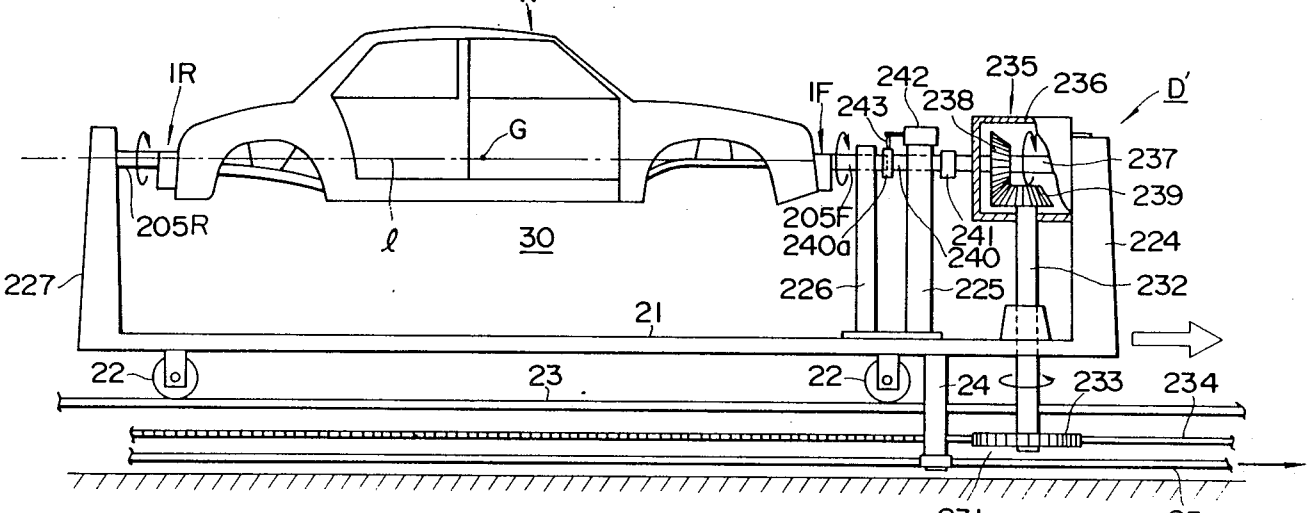
FIG. 45 is a side view illustrating another example of a carriage with a rotation device for rotating a coating substrate.
Figure 47:
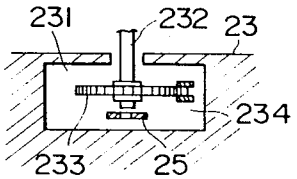
FIG. 47 is a cross-sectional view taken along the line X47—X47 in FIG. 46.
Figure 46:
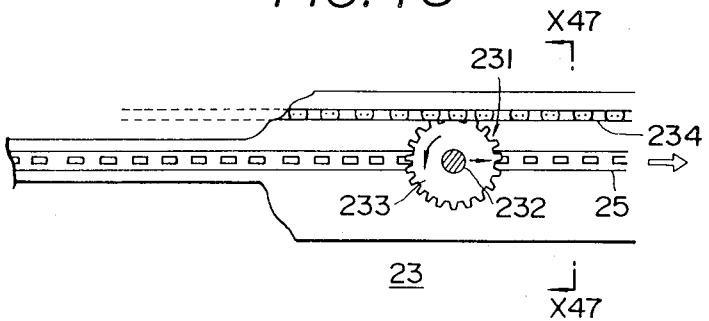
FIG. 46 is a partially cut-away front view illustrating the essential part of a converting mechanism in FIG. 45.

FIGS. 45 to 47 show another example of variants in carriages. The carriage D' is constructed so as to rotate the vehicle body W utilizing a displacement of the carriage D' against the rails 23, 23. The rotation devices 1F' and 1R' as shown in FIGS. 43 and 44 may be used for the carriage D'. The same elements are represented by the same reference numerals as shown in FIG. 5. On the base 21 is mounted one front support 224, two intermediate supports 225, 226, and one rear support 227, each standing upright. Between the intermediate support 226 and the rear support 227 is a supporting space 30 extending long in the front and rear directions, where the vehicle body W is supported when loaded.

The vehicle body W is loaded on the carriage D' and supported in the supporting space 30 rotatively to the intermediate support 226 and the rear support 227. The vehicle body W is disposed to be rotated at the front portion thereof against the intermediate support 226 by means of the front rotation device 1F' and at the rear portion thereof against the rear support 227 by means of the rear rotation device 1R'.

Figure 28:
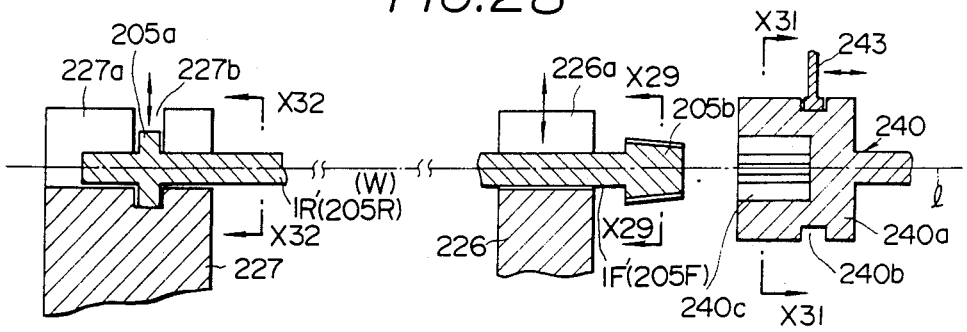
FIG. 28 is a cross-sectional side view illustrating another example of a connection portion between the rotation device and the carriage.
Figure 32:
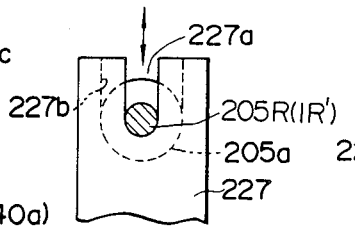
FIG. 32 is a cross-sectional view taken along the line X32—X32 in FIG. 28.
Figure 33:
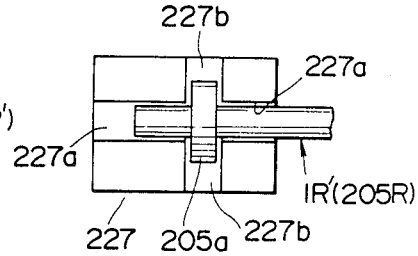
FIG. 33 is a plane view of FIG. 32.

The front rotation shaft 205F of the front rotation device 1F' is disposed to be rotatively connected to or disconnected from the intermediate support 226 in a downward or upward direction. The rear rotation shaft 205R of the rear rotation device 1R' is likewise disposed to be rotatively connected to or disconnected from the rear support 227 in a downward or upward direction, and the rear rotation device 1R' is engaged tightly in the direction of the rotational axis l. The intermediate support 226 is provided with a cut-away portion **226*a* opening toward the upper end surface (FIGS. 28, 29 and 30), and the rear support 227 is also provided with a cut-away portion 227*a* opening toward the upper end surface (FIGS. 28, 32 and 33). These cut-away portions 226*a* and 227*a* are formed in a size sufficiently large to insert the rotation shafts 205F and 205R of the front and rear rotation devices 1F' and 1R' in a secured manner, respectively. The rear rotation shaft 205R of the rotation device 1R' is provided with a flange portion 205*a*, and the rear support 227 is provided with a second cut-away portion 227*b* in a shape corresponding to and engageable with the flange portion 205*a* of the rear rotation shaft 205R communicating with the first cut-away portion 227*a*. This construction permits the connection or disconnection of the rear rotation device 1R' to or from the first and second cut-away portions 227*a* and 227*b* of the rear support 227 in a downward or upward direction and causes the rear rotation device 1R' to be so held in the flange portion 205*a* of the rotation shaft 205R tightly and securedly by the stopper action of the flange portion 205*a*** so as to move in neither forward nor backward direction.

The vehicle body W is designed so as to be rotated by the front rotation shaft 205F of the front rotation device 1F' so that the front rotation shaft 205F is provided at its end portion with a connection portion **205*b* as will be described below (see also FIG. 43**).

A converting mechanism 231 is disposed to convert a displacement of the carriage D' against the rails 23, 23 into a rotation. The converting mechanism 231 contains a rotation shaft 232 extending from the base 21 in an upward and downward direction and being supported rotatively on the base 21, a sprocket 233 fixed on the lower end portion of the rotation shaft 232, and a chain 234 engaged with the sprocket 233. The chain 234 is disposed parallel to the retraction wire 25 and in such a state that it does not move along the rails 23, 23. Thus, as the carriage D' is conveyed by retracting the retraction wire 25, the sprocket 233 is caused to be rotated while engaged with the chain 234 disposed in an unmovable manner, thus leading to the rotation of the rotation shaft 232.

A transmitting mechanism 235 is disposed to transmit the rotation of the rotation shaft 232 to the front rotation shaft 205F of the front rotation device 1F'. The transmitting mechanism 235 contains a casing 236 fixed on the rear surface of the front support 224, a rotation shaft 237 extending from the casing 236 in the transverse (front and rear) direction and supported rotatively thereby, a pair of bevel gears 238 and 239 for rotating the rotation shaft 237 in association with the rotation shaft 232, and a connection shaft 240 connected to the front support 225 rotatively and slidably in the front and rear directions. The connection shaft 240 is connected to the rotation shaft 237 in a spline manner at a position represented by 241 in FIG. 45. This construction permits a rotation of the connection shaft 240 in association with the rotation of the rotation shaft 232. The rotation shaft 237 and the connection shaft 240 are disposed to allow their axes to be located in the line coinciding with the rotational axis l.

Figure 29:
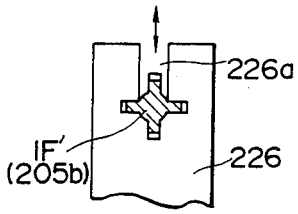
FIG. 29 is a cross-sectional view taken along the line X29—X29 in FIG. 28.
Figure 30:
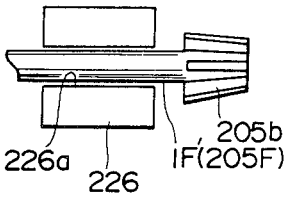
FIG. 30 is a plane view of FIG. 28.
Figure 31:
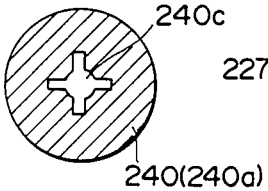
FIG. 31 is a cross-sectional view taken along the line X31—X31 in FIG. 28.

As shown in FIGS. 28 to 30, the connection shaft 240 is connected to or disconnected from the front rotation shaft 205F of the front rotation device 1F'. A connecting portion **205*b* in a cross shape is formed on the top end portion of the front rotation shaft 205F of the front rotation device 1F', and a box portion 240*a* having an engaging hollow 240*c* engageable tightly with the connecting portion 205*b* is provided at the rear portion of the connection shaft 240. By moving the connection shaft 240 in a sliding manner through a rod 243, for example, using a hydraulic cylinder 242, the connecting portion 205*b* is connected to or disconnected from the engaging hollow 240*c* of the box portion 240*a*. The connection shaft 240 is rotated integrally with the rotation shaft 205 when they engage each other. The rod 243 is disposed inside a ring groove 240*b* formed on the outer periphery of the box portion 240*a* in a manner to interface with the rotation of the connection shaft 240**.

This arrangement enables the rotation shafts 205F and 205R of the respective front and rear rotation devices 1F' and 1R' to be supported to the intermediate support 226 and the rear support 227 rotatively in such a state as being unmovable in the front and rear directions by lowering the vehicle body W down to the carriage D' in a state that the connection shaft 240 is displaced to the right in FIG. 45. Thereafter the connecting portion **205*b* of the rotation shaft 205F is engaged with the engaging hollow 240*c* of the connection shaft 240, whereby the vehicle body W is allowed to rotate about a predetermined rotational axis l by retracting the carriage D' by the retraction wire 25**. The vehicle body W may be unloaded from the carriage D' by the order of the procedures opposite to the order of the procedures for loading.

It is to be noted further that, if the chain 234 would be arranged so as to be driven by a motor or so on to be mounted separately, the vehicle body W can be rotated even in a state that the carriage D' is suspended.

Variants in Paints (Powder Coating)

In the spraying step P2, a powder coating may be used for spraying on the vehicle body W.

Figure 48:
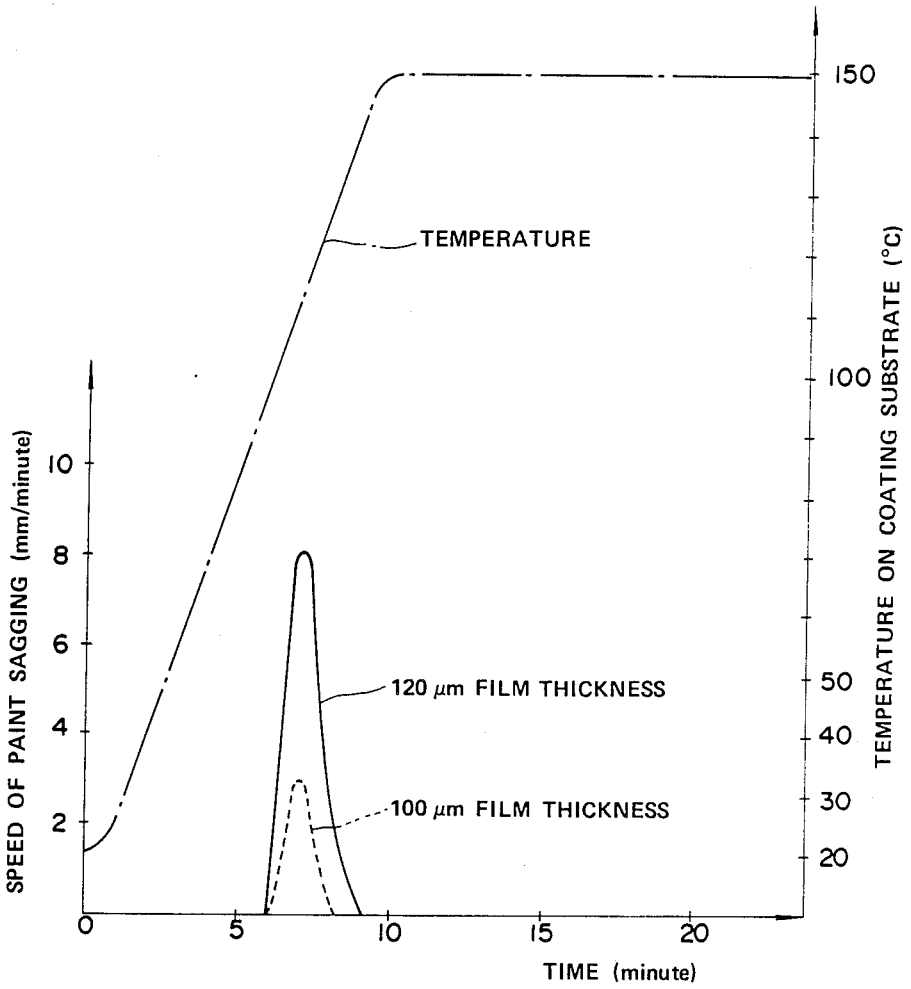
FIG. 48 is a graph showing the relationships of speeds of sagging and temperatures on a coating substrate vs. film thicknesses and times.

FIG. 48 shows influences of film thicknesses of powder coatings on limits on sags, in which two cases of film thicknesses of 100 μm and 120 μm are given. It is to be understood from the results of FIG. 48 that in each case a heat flow is caused in 5 to 10 minutes after the start of baking. In conventinal coating procedures for spraying a powder coating, a maximum film thickness in the spraying step P2 is restricted to as thick as 80 μm or less on account of sags caused by the heat flow.

On the other hand, the method according to the present invention permits a powder coating to be sprayed on the vehicle body W in the spraying step P2 in a film thickness thicker than 80 μm—even 100 μm, for example. In the baking step P4 according to the present invention during which the heat flow is caused, the vehicle body W is caused to rotate. It is to be noted here that the rotation of the vehicle body W may be conducted at least during a period of time when the heat flow occurs. It is not necessary to rotate the vehicle body W during a whole period of time of the baking step P4.

It is further noted that, in instances where a powder coating is used, the setting step P3 for evaporating a solvent in the range of low temperatures can be omitted because the powder coating contains no such solvent.

The tests shown in FIG. 48 were conducted under the following conditions:

(a) Paint: acrylic powder coating ("Powdax A"; Nippon Paint K.K.)
(b) Coater: electrostatic powder coating device (Model: GX101; Onoda Cement K.K.)
(c) Applied voltage: −60 KV
(d) Rate of Coating: 180 grams/minute
(e) Pressure of air conveying paint: 2.0 kg/cm$^2$
(f) Distance of spraying: 25 cm Variants in Paints (Two-Part Thermosetting Paint)

In the sprayig step P2 according to the step of the present invention, a two-part thermosetting paint may be used as a coating paint, in which it contains a resin as a main component and a curing agent.

Figure 49:
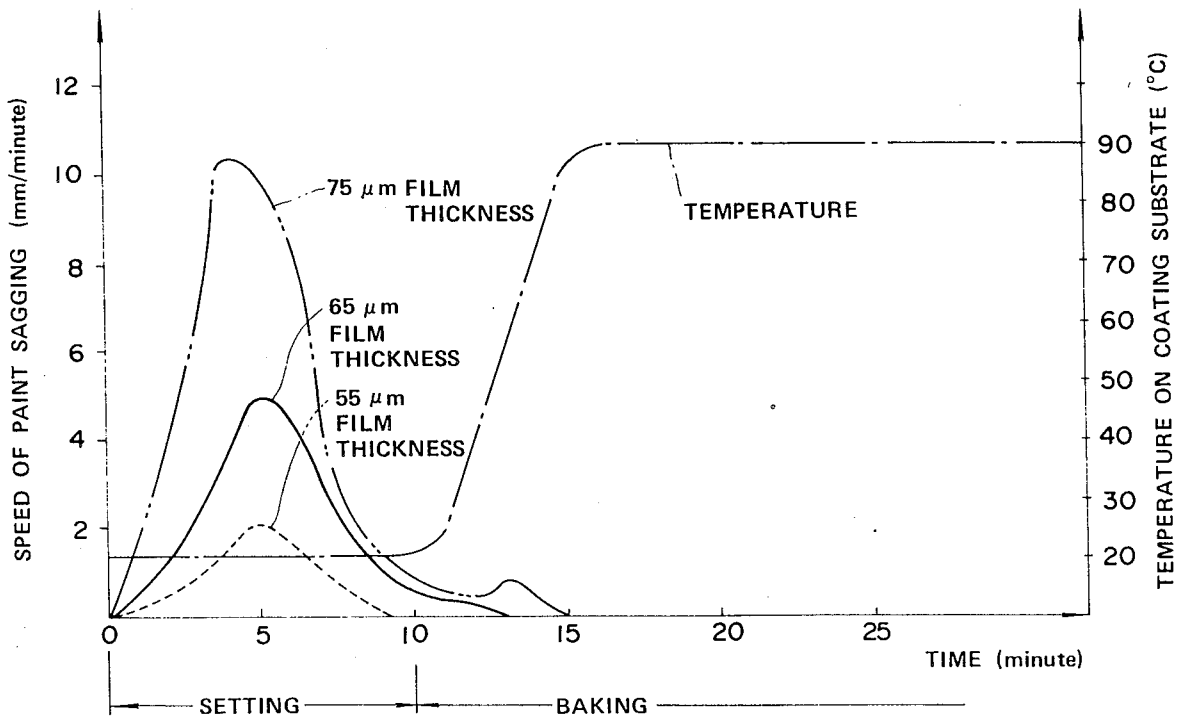
FIG. 49 is a graph showing the relationships of speeds of sagging and temperatures on a coating substrate vs. film thicknesses and times elapsing for setting and baking.

FIG. 49 shows influences of film thicknesses of a two-part thermosetting paint on limits of sags, in which three cases of 55 μm, 65 μm and 75 μm are given. It is to be noted that in each case a peak of sags is caused to occur in the middle stage of the setting step P3 and no sags are caused to occur in the baking step P4.

In conventional coating procedures, on the one hand, a maximum film thickness of a two-part thermosetting paint sprayed in the spraying step P2 cannot exceed 40 μm on account of sags caused to occur in the setting step P3. In accordance with the present invention, on the other hand, a maximum film thickness of a two-part thermosetting paint sprayed on the vehicle body W in the spraying step P2 can be as thick as 65 μm, for example, because the vehicle body W is caused to rotate in the setting step P3 where sags occur. It is further noted herein that it is not necessary to cause the vehicle body W to rotate in the baking step P4.

The test conditions used in FIG. 49 are as follows:

(a) Paint: polyester urethane paint white ("R-263"; Nippon Bee Chemical K.K.)
Main resin: polyester polyol white
Curing agent: hexamethylene diisocyate
Mixing ratio (weight): 4 (main resin) to 1 (curing agent)
(b) Coater: compression-type air spray gun (Model "WIDER-W71"; Iwata Tosoki K.K.)
(c) Spraying viscosity: 16 seconds/Ford Cup #4)
(d) Spraying rate: 350 cc/minute
(e) Atomizing air pressure: 4.0 kg/cm$^2$
(f) Spraying distance: 30 cm
(g) Number of coatings: two (intervals: 3 minutes)

Further Variants

The present invention may be performed by further variants as follows:

(a) Springs:

As the spring as a source of driving the rotation may be employed a gas spring comprising a cylinder in which gases are enclosed under a predetermined pressure and piston rod inserted in the cylinder. A restoring force produced by the gas spring is embodied as a straight movement of the piston rod so that the straight movement may be converted into a rotational movement, for example, by a rack or a pinion.

The spring for the start-up of the rotation may also be a one-way clutch instead of the clutch 85 of the friction type as shown in FIG. 15.

(b) Coating substrates:

The coating substrates to which the present invention can be applicable may further include, for example, casings for electric utensils and steel household furnishings.

(c) Switching of rotation:

The switching from the rotation of the vehicle body W to the suspension thereof or vice versa and a shift in the rotational direction of the vehicle body W may be conducted using an actuator for exclusive use such as an air motor, regardless of whether the carriage D' is being conveyed or suspended.

Referring to FIG. 45, the sprocket 233 may be provided with a pair of first chains engaging with another pair of second chains (each corresponding to the chain 234) from the opposite side in the diametric direction. Each of the chains are operatively driven. In this case, a rack bar or a pinion may be used instead of the chain 234 or the sprocket 233.

When the first chains are suspended and the second chains are in a free state, the vehicle body W is caused to rotate in one direction in association with the conveyance of the carriage D'.

When the first chains are in a free state and the second ones are suspended, the vehicle body W is caused to rotate in the direction opposite to the direction rotated in the above instance, as the carriage D' is being conveyed.

When the first and second chains are all in a free state, the vehicle body W is not caused to rotate.

When the first chains are driven in one direction and the second ones are in a free state, the vehicle body W is caused to rotate in one direction even if the carriage D' is suspended.

When the first chains are driven in other directions and the second one are in a free state or vice versa, the vehicle body W is caused to rotate in the direction opposite to that rotated in the immediately above instance even if the carriage D' is suspended.

Referring again to FIG. 45, a rack bar or a pinion may be employed instead of the chain 234 or the sprocket 233. In instances where the rack bar is disposed in a fixed state (given the conveyance of the carriage D' for the rotation of the vehicle body W in this case), the rack bar may be disposed at intervals or on the left-hand and right-hand sides at predetermined positions. This arrangement permits a rotation of the vehicle body W in a predetermined direction and a suspension of the vehicle body W at a predetermined position as the carriage D' is conveyed to a predetermined position.

What is claimed is:

1. A coating method in a coating line for coating a vehicle body with a paint containing a volatilizable solvent to form a highly reflective surface coating on the body, comprising:

a spraying step in which the paint is sprayed to form a coat in a film thickness thicker than a thickness at which the paint sags on a surface extending at least upwardly and downwardly; and a drying step comprising sequential setting and baking steps in which the body is held in an ambient temperature during the setting step which is lower than the ambient temperature during the baking step and in which the body having substantially all the applied coat thereon is rotated about its horizontal axis until the paint sprayed thereon achieves a substantially sagless state, the rotation of the body in the setting step being carried out at a speed which is high enough to rotate the body from a vertical position to a horizontal position before the paint coated thereon substantially sags due to gravity yet which is low enough so as to cause no sagging as a result of centrifugal force.

2. The coating method according to claim 1, further comprising rotating the body about its horizontal axis during the baking step after the substantially sagless state is achieved.

3. The coating method according to claim 1 or 2, in which the setting step substantially volatilizes the solvent in the paint.

4. The coating method according to claim 3, in which a preparation step is carried out prior to the spraying step for cleaning the body by removing foreign materials therefrom and in which the body is rotated about its horizontal axis in the preparation step.

5. The coating method according to claim 4, in which the body is conveyed from the preparation step to the drying step while being supported by a carriage with a rotation device on the carriage for rotating the body about its horizontal axis.

6. The coating method according to claim 5, in which the body is conveyed from the preparation step to the drying step on a single carriage.

7. The coating method according to claim 3, in which the paint sprayed is a two-part curing-type paint in a volatilizable solvent and the temperature of the setting step is high enough to substantially volatilize the solvent.

8. The coating method according to claim 7, wherein the two-part curing paint has a sagging threshold value of about 40 μm.

9. The coating method according to claim 3, in which the paint sprayed is a thermosetting-type paint in a volatilizable solvent and the temperature of the setting step is high enough to substantially volatilize the solvent without curing the paint.

10. The coating method according to claim 9, wherein the thermosetting-type paint has a sagging threshold value of about 40 μm.

11. The coating method according to claim 9, wherein the further rotation during the baking step is carried out at least at the beginning of the baking step.

12. The coating method according to claim 3, in which the body is rotated in one direction.

13. The coating method according to claim 12, in which the rotation is carried out continuously.

14. The coating method according to claim 12, in which the rotation is carried out intermittently.

15. The coating method according to claim 3, in which the body is rotated first in one direction and then in the opposite direction.

16. The coating method according to claim 15, in which the rotation is carried out continuously in the one direction and continuously in the opposite direction.

17. The coating method according to claim 15, in which the rotation is carried out intermittently in the one direction and intermittently in the opposite direction.

18. The coating method according to claim 15, in which the rotation in the one direction is carried through an angle of at least 90 degrees and the rotation in the opposite direction is carried through an angle of at least 90 degrees.

19. The coating method according to claim 3, in which the body is rotated so that the horizontal axis coincides substantially with the gravitational center of the body.

20. The coating method according to claim 3, in which the body has a rotational axis which extends in front and rear directions of the body.

21. The coating method according to claim 3, in which the body is rotated at a speed of 380 cm per second or lower as measured at a radially outward tip portion of the body.

22. The coating method according to claim 3, wherein the body to be coated has already had coated thereon an intermediate coat.

23. The coating method according to claim 3, in which the temperature in the setting step is in the room temperature range.

24. The coating method according to claim 3, in which the body is held substantially stationary during the spraying step.

25. The coating method according to claim 1 or 2, in which the paint sprayed is a thermosetting-type paint in a volatilizable solvent and the temperature of the setting step is high enough to substantially volatilize the solvent without curing the paint.

26. The coating method according to claim 25, wherein the thermosetting-type paint has a sagging threshold value of about 40 μm.

27. The coating method according the claim 25, wherein the further rotation during the baking step is carried out at least at the beginning of the baking step.

28. The coating method according to claim 25, in which the total sagging is no more than 2 mm.

29. The coating method according to claim 1 or 2, in which the paint sprayed is a two-part curing-type paint in a volatilizable solvent and the temperature of the setting step is high enough to substantially volatilize the solvent.

30. The coating method according to claim 29, wherein the two-part curing paint has a sagging threshold value of about 40 μm.

31. The coating method according to claim 1 or 2, in which a preparation step is carried out prior to the spraying step for cleaning the body by removing foreign materials therefrom and in which the body is rotated about its horizontal axis in the preparation step.

32. The coating method according to claim 31, in which the body is conveyed from the preparation step to the drying step while being supported by a carriage with a rotation device on the carriage for rotating the body about its horizontal axis.

33. The coating method according to claim 32, in which the body is conveyed from the preparation step to the drying step on a single carriage.

34. The coating method according to claim 1 or 2, in which the body is rotated in one direction.

35. The coating method according to claim 34, in which the rotation is carried out continuously.

36. the coating method according to claim 34, in which the rotation is carried out intermittently.

37. The coating method according to claim 1 or 2, in which the body is rotated first in one direction and then in the opposite direction.

38. The coating method according to claim 37, in which the rotation is carried out continuously in the one direction and continuously in the opposite direction.

39. The coating method according to claim 37, in which the rotation is carried out intermittently in the one direction and intermittently in the opposite direction.

40. The coating method according to claim 37, in which the rotation in the one direction is carried through an angle of at least 90 degrees and the rotation in the opposite direction is carried through an angle of at least 90 degrees.

41. The coating method according to claim 1 or 2, in which the body is rotated so that the horizontal axis coincides substantially with the gravitational center of the body.

42. The coating method according to claim 1 or 2, in which the body has a rotational axis which extends in front and rear directions of the body.

43. The coating method according to claim 1 or 2, wherein the body to be coated has already had coated thereon an intermediate coat.

44. The coating method according to claim 1 or 2, in which the body is held substantially stationary during the spraying step.

45. The coating method according to claim 1 or 2, in which the temperature in the setting step is in the room temperature range.

46. The coating method according to claim 1, in which the body is rotated at a speed of 380 cm per second or lower as measured at a radially outward tip portion of the body.

* * * * *